US009304438B2

(12) United States Patent
Shimizu et al.

(10) Patent No.: US 9,304,438 B2
(45) Date of Patent: Apr. 5, 2016

(54) DEVELOPER CONTAINER AND IMAGE FORMING APPARATUS INCLUDING THE SAME

(71) Applicant: KYOCERA Document Solutions Inc., Osaka-shi, Osaka (JP)

(72) Inventors: Tamotsu Shimizu, Osaka (JP); Shizuka Ikazaki, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/525,633

(22) Filed: Oct. 28, 2014

(65) Prior Publication Data

US 2015/0117909 A1 Apr. 30, 2015

(30) Foreign Application Priority Data

Oct. 30, 2013 (JP) ..... 2013-225561

(51) Int. Cl.
*G03G 15/08* (2006.01)

(52) U.S. Cl.
CPC ..... *G03G 15/0877* (2013.01)

(58) Field of Classification Search
CPC ..... G03G 15/08
USPC ..... 399/263
See application file for complete search history.

(56) References Cited

U.S. PATENT DOCUMENTS

2007/0177903 A1* 8/2007 Oda ..... 399/262
2008/0260431 A1* 10/2008 Saito ..... 399/256
2011/0103846 A1 5/2011 Ota
2012/0263496 A1* 10/2012 Morita ..... 399/119
2012/0274782 A1 11/2012 Kitaguchi
2013/0101318 A1* 4/2013 Shimizu et al. ..... 399/258
2013/0136502 A1 5/2013 Shimizu

FOREIGN PATENT DOCUMENTS

JP 2008-275739 11/2008
JP 2011099894 A 5/2011
JP 2012230346 A 11/2012
JP 2013113893 A 6/2013

OTHER PUBLICATIONS

Japanese Office Action Issued on Jan. 19, 2016.

* cited by examiner

*Primary Examiner* — Clayton E Laballe
*Assistant Examiner* — Fang-Chi Chang
(74) *Attorney, Agent, or Firm* — Gerald E. Hespos; Michael J. Porco; Matthew T. Hespos

(57) ABSTRACT

A developer container includes a container housing for storing developer, a cylinder section projecting from the container housing and including a developer discharge port, and a rotary member for conveying the developer to the discharge port. The rotary member includes a rotary shaft rotatably supported and having a first part located in the container housing and a second part located in the cylinder section, and a resilient member projecting from the second part of the rotary shaft in a radial direction of rotation of the rotary member and facing the developer discharge port. The resilient member includes a tip end operable to protrude radially outward out of the developer discharge port after rubbing an inner surface of the cylinder section as the rotary shaft of the rotary member makes rotation.

15 Claims, 15 Drawing Sheets

DEVELOPER CONTAINER AND IMAGE FORMING APPARATUS INCLUDING THE SAME

INCORPORATION BY REFERENCE

This application is based on Japanese Patent Application No. 2013-225561 filed with the Japan Patent Office on Oct. 30, 2013, the contents of which are hereby incorporated by reference.

BACKGROUND

The present disclosure relates to a developer container for storing developer and an image forming apparatus including the same.

Conventionally, there is known a developer container for storing developer, including a container housing, a rotary member, and a developer discharge port. When the container housing stores developer, the rotary member is driven for rotation to convey the developer to the developer discharge port. Upon attachment of the developer container to a developing device for receiving developer supplied from the developer container, the developer discharge port faces a developer receiving port formed in the developing device. The developer conveyed by the rotary member falls through the developer discharge port and flows into the developing device through the developer receiving port.

In the prior art, a developing device is known to be provided with a stirring member having a film member projecting therefrom in order to prevent aggregation of developer between the developer discharge port and the developer receiving port, the film member protruding upward out of the developer receiving port according to rotation of the stirring member.

SUMMARY

A developer container according to an aspect of the present disclosure supplies developer to a reception unit including a developer receiving port. The developer container includes a container housing, a cylinder section, and a rotary member.

The container housing includes a bottom wall and stores developer. The cylinder section joins the bottom wall and projects from the container housing, the cylinder section including a lower surface formed with a developer discharge port facing the developer receiving port. The rotary member extends in the container housing and the cylinder section, and is operable to be rotationally driven to convey the developer in the container housing to the developer discharge port.

The rotary member includes a rotary shaft and a resilient member. The rotary shaft is rotatably supported on the container housing and the cylinder section, the rotary shaft extending in an extending direction of the bottom wall, and including a first part located in the container housing and a second part located in the cylinder section. The resilient member projects from the second part of the rotary shaft in a radial direction of rotation of the rotary member and faces the developer discharge port. The resilient member includes a tip end operable to protrude radially outward out of the developer discharge port after rubbing an inner surface of the cylinder section as the rotary shaft of the rotary member makes rotation.

An image forming apparatus according to another aspect of the present disclosure includes an image carrier including a surface for allowing an electrostatic latent image to be formed thereon, the reception unit having the developer receiving port and serving as a developing device for supplying the developer to the image carrier, and the above-described developer container for supplying the developer to the developing device.

These and other objects, features and advantages of the present disclosure will become more apparent upon reading the following detailed description along with the accompanying drawings.

DETAILED DESCRIPTION

Figure 1:
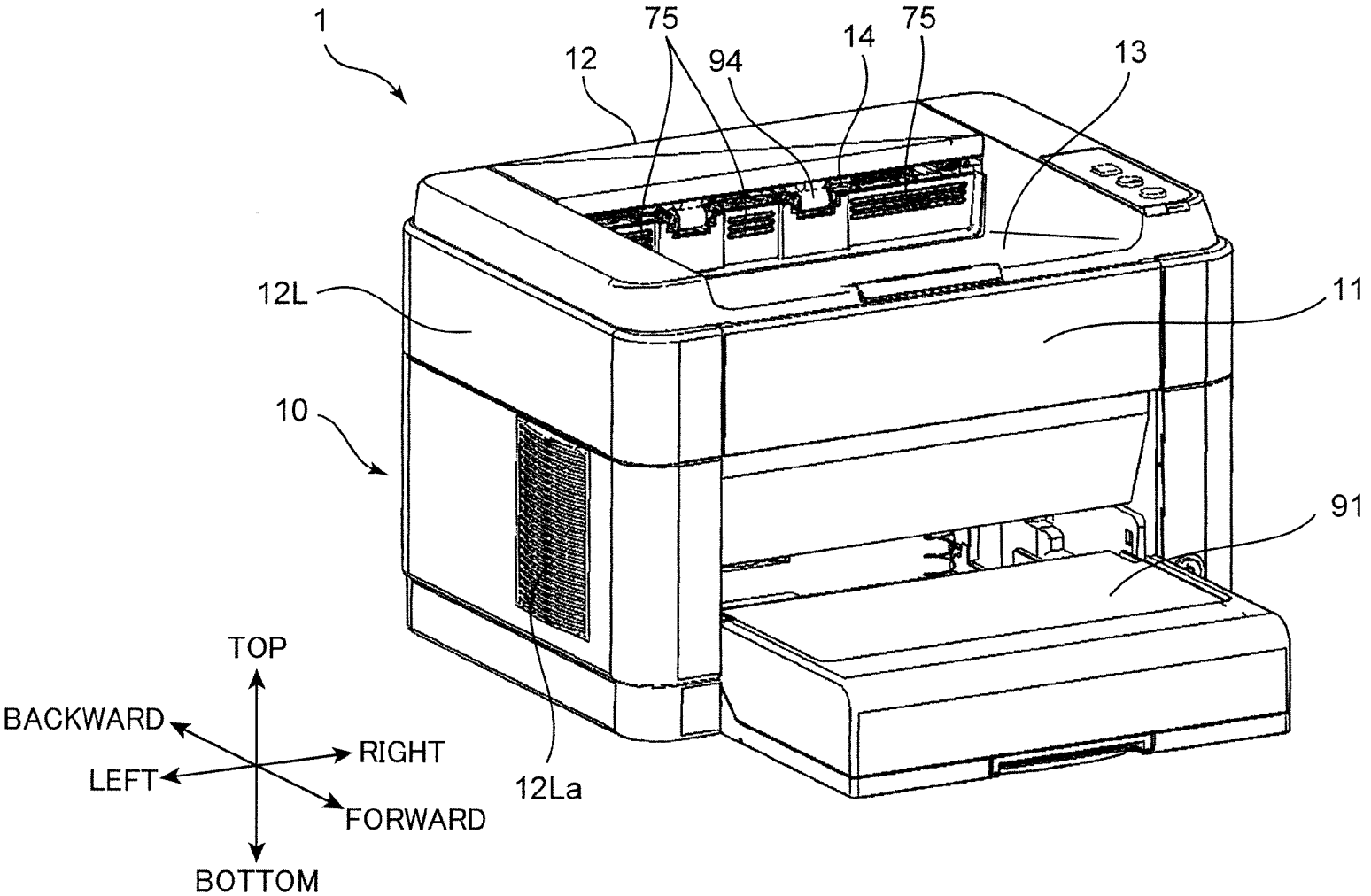
FIG. 1 is an external perspective view of an image forming apparatus according to a first embodiment of the present disclosure.
Figure 2:
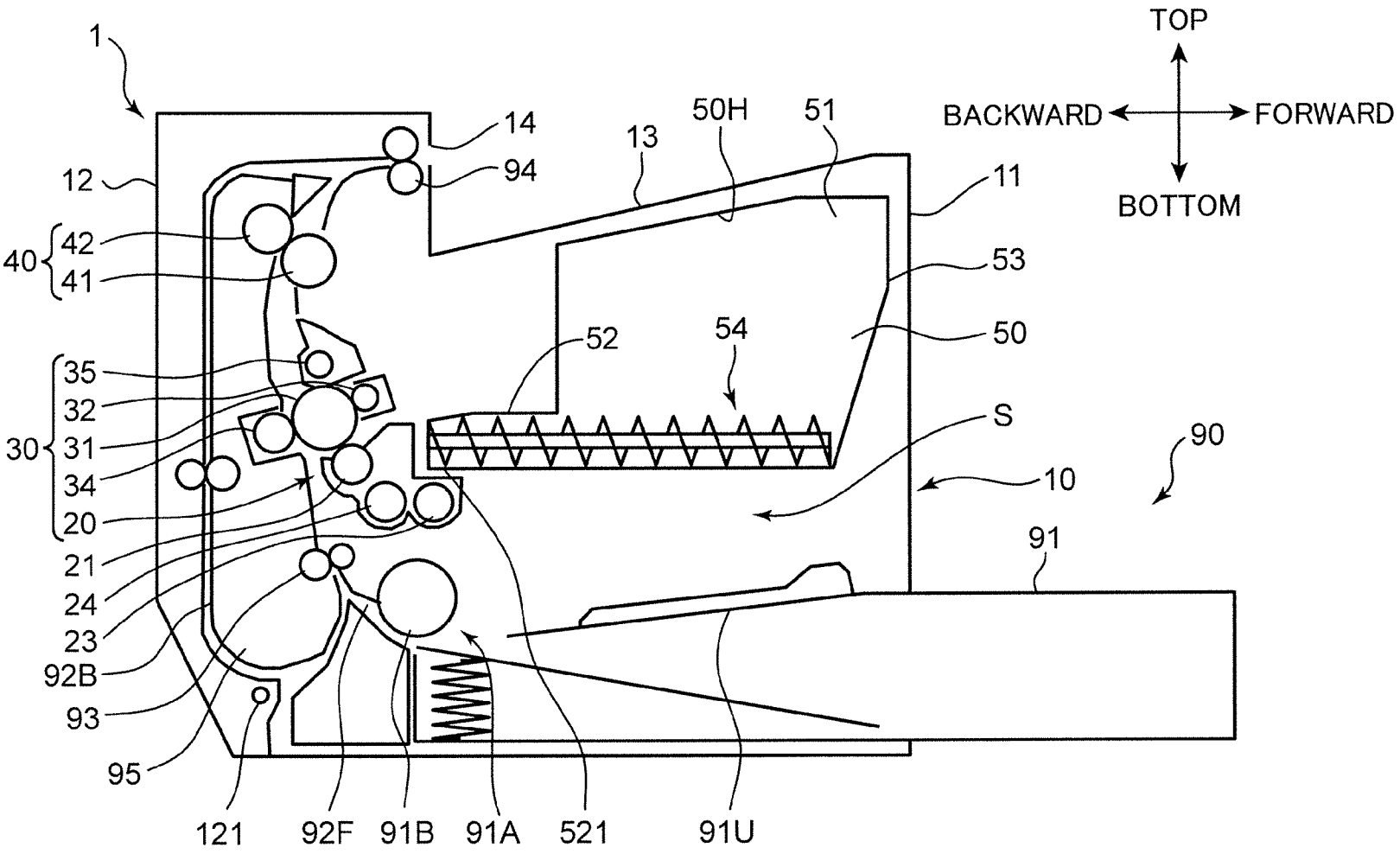
FIG. 2 is a sectional view showing an internal structure of the image forming apparatus.

Hereinafter, embodiments of the present disclosure will be described in detail with reference to the accompanying drawings. FIG. 1 is an external perspective view of an image forming apparatus 1 according to a first embodiment of the present disclosure. FIG. 2 is a sectional side view showing an internal structure of the image forming apparatus 1. Here, the image forming apparatus 1 will be illustrated as a monochrome printer, but it may alternatively be provided as a copier, a facsimile apparatus or a multifunction device equipped with all of these functions, or an image forming apparatus for forming a color image.

The image forming apparatus 1 includes a main housing 10 having a substantially rectangular parallelepiped casing structure, and an image forming section 30, a fixing section 40, a toner container 50 (developer container), and a sheet feeding section 90 housed in the main housing 10.

The main housing 10 has a front cover 11 at a front side thereof and a rear cover 12 at a rear side thereof. The front cover 11 can be opened to expose the toner container 50 on the front of the main housing 10. This allows a user to dismount the toner container 50 from the front of the main housing 10 when toner runs out. The rear cover 12 is opened when a sheet jam occurs or for carrying out maintenance. The image forming section 30 and the fixing section 40 each can be dismounted from the rear side of the main housing 10 by opening the rear cover 12.

The lateral sides of the main housing 10 include a left cover 12L (FIG. 1) and a right cover 12R (not shown in FIG. 1). The left cover 12L includes an air intake port 12La. An upper surface of the main housing 10 includes a discharge section 13 to which a sheet having been subjected to image formation is discharged. The main housing 10 defines an internal space S (FIG. 2) where various components for image formation are placed.

The image forming section 30 performs image formation for forming a toner image on a sheet fed from the sheet feeding section 90. The image forming section 30 includes a photoconductive drum 31 (image carrier), and a charging device 32, an exposure device (not shown in FIG. 2), a developing device 20, a transfer roller 34, and a cleaning device 35 disposed around the photoconductive drum 31.

The photoconductive drum 31 includes a circumferential surface for carrying an electrostatic latent image and a toner image corresponding to the electrostatic latent image. The photoconductive drum 31 may be made of an amorphous silicon (a-Si) material. The charging device 32 charges the circumferential surface of the photoconductive drum 31 uniformly. The cleaning device 35 includes an unillustrated cleaning blade for cleaning toner adhered to the circumferential surface of the photoconductive drum 31 after a toner image is transferred therefrom.

The exposure device includes a laser light source and an optical device such as mirror and lens for irradiating the circumferential surface of the photoconductive drum 31 with light to form an electrostatic latent image, the light having been modulated in accordance with image data received from an external device such as personal computer.

The developing device 20 supplies toner to the circumferential surface of the photoconductive drum 31 to develop the electrostatic latent image formed on the photoconductive drum 31 into a toner image. The developing device 20 includes a developing roller 21 for carrying toner to be supplied to the photoconductive drum 31, and a first stirring screw 23 and a second stirring screw 24 for circulatively conveying developer in a developing housing 210 (FIG. 3) while stirring it. The developing device 20 serves as a reception unit for receiving replenishment toner supplied from the toner container 50. The developing device 20 according to the present embodiment will be described in detail later.

The transfer roller 34 is used for transferring a toner image formed on the circumferential surface of the photoconductive drum 31 onto a sheet.

The fixing section 40 performs fixing processing for fixing the transferred toner image on the sheet. The fixing section 40 includes a fixing roller 41 having a built-in heating source, and a pressing roller 42 which is brought into pressure contact with the fixing roller 41 to define a fixing nip with the fixing roller 41 therebetween. The sheet having a toner image transferred thereon passes through the fixing nip where the toner image is heated by the fixing roller 41 and pressed by the pressing roller 42 to be fixed onto the sheet.

The toner container 50 stores replenishment toner (replenishment developer). The toner container 50 supplies the replenishment toner to the developing device 20. The toner container 50 includes a container housing 51 (container housing) where most of replenishment toner is stored, a cylinder section 52 projecting from a lower part of one side of the container housing 51, a cover member 53 covering the other side of the container housing 51, and a rotary member 54 placed in the container for conveying toner. The rotating member 54 is rotationally driven to supply replenishment toner stored in the toner container 50 into the developing device 20 through a toner discharge port 521 provided in the lower surface of the end of the cylinder section 51. Further, there is provided a container top plate 50H covering the toner container 50 from above, the container top plate 50H being located under the discharge section 13 (see FIG. 2).

The sheet feeding section 90 includes a sheet feeding cassette 91 (FIG. 2) for storing sheets to be subjected to image formation. The top of a part of the sheet feeding cassette 91 that lies in the main housing 10 is covered by a sheet feeding cassette top plate 91U. The sheet feeding cassette 91 includes a sheet storage space for storing a stack of sheets, a lift plate for lifting the stack of sheets for feeding a sheet, and the like. A sheet feeder 91A is provided at an upper rear end of the sheet feeding cassette 91. The sheet feeder 91A includes a sheet feeding roller 91B for feeding sheets one by one from the top of the stack of sheets in the sheet feeding cassette 91.

The main housing 10 includes therein a main conveyance passage 92F and a reverse conveyance passage 92B for conveyance of a sheet. The main conveyance passage 92F extends from the sheet feeder 91A of the sheet feeding section 90 to a sheet discharge port 14 through the image forming section 30 and the fixing section 40, the sheet discharge port 14 facing the sheet discharge section 13 provided in the upper surface of the main housing 10. The reverse conveyance passage 92B is used for returning a sheet having one side printed to the upstream side of the image forming section 30 in the main conveyance passage 92F in a case where the other side of the sheet also needs to be printed.

On the upstream side of a transfer nip in the main conveyance passage 92F, there is provided a pair of register rollers 93. A sheet is temporally stopped by the pair of register rollers 23 to be subjected to skew correction, and then fed into the transfer nip at a predetermined timing for image transfer. A plurality of conveyance rollers for conveying a sheet is disposed at proper positions in the main conveyance passage 92F and the reverse conveyance passage 92B. For example, a pair of discharge rollers 94 is disposed near the sheet discharge port 14. Further, there is formed an air discharge port 75 (FIG. 1) for discharging air warmed in the internal space S by the fixing section 40, the air discharge port 75 being located under the sheet discharge port 14.

The reverse conveyance passage 92B is defined between an outer surface of a reversing unit 95 and an inner surface of the rear cover 12 of the main housing 10. The rear cover 12 and the reversing unit 95 are each rotatable about an axis of a fulcrum 121 provided at their lower ends.

<Description of Developing Device>

Figure 3:
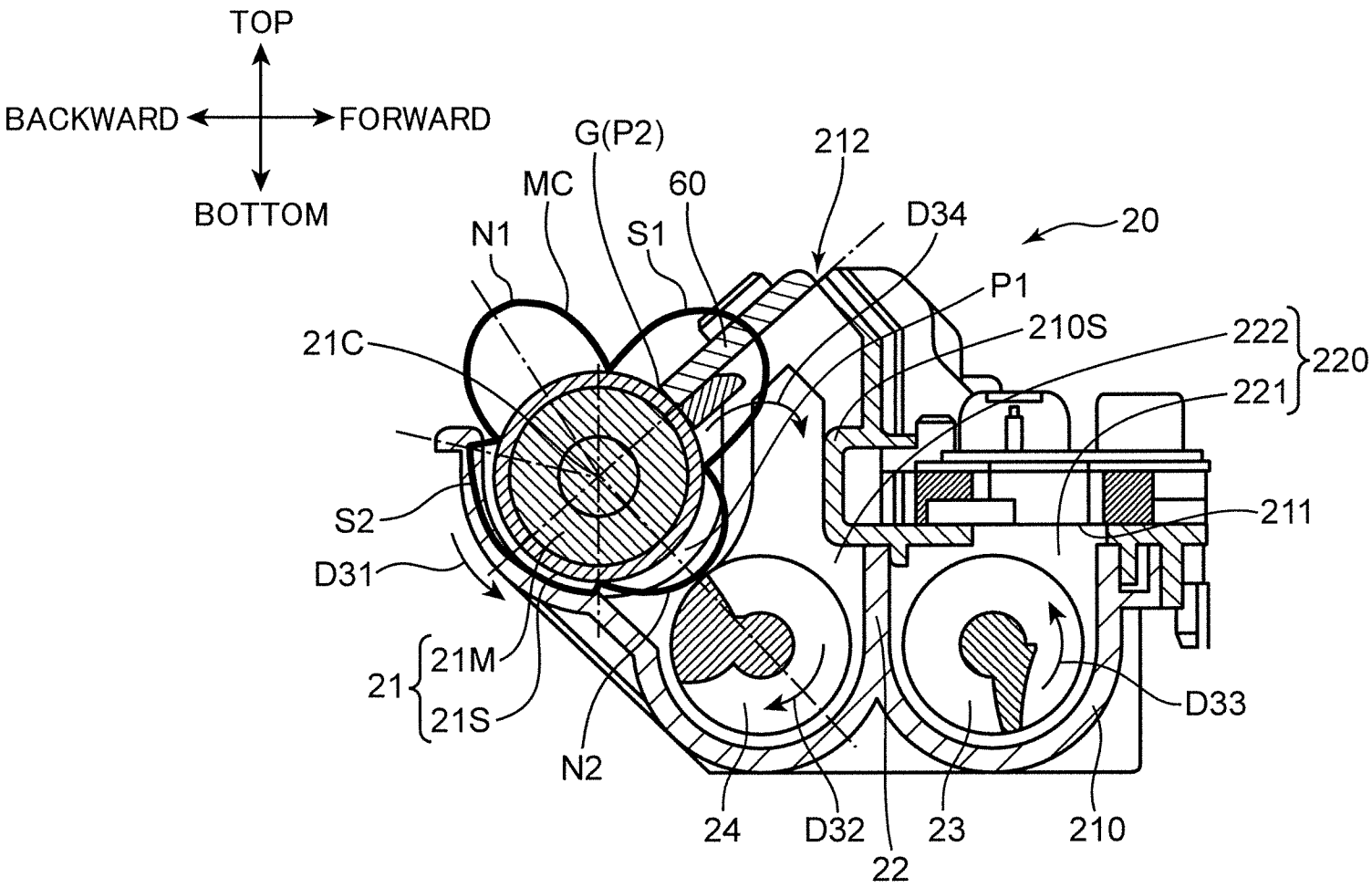
FIG. 3 is a sectional side view of a developing device according to the first embodiment of the present disclosure.
Figures 4A, 4B:
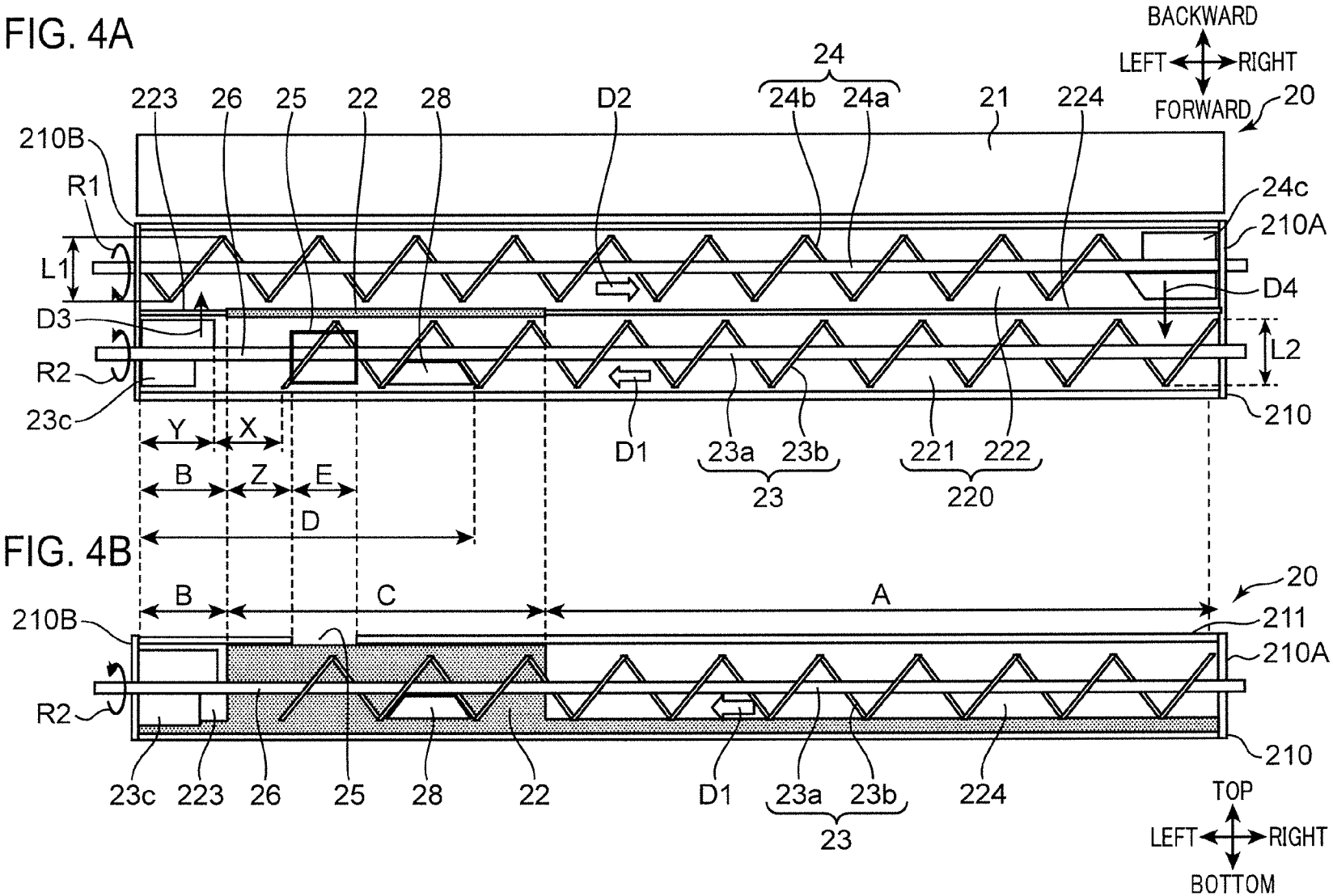
FIG. 4A is a plan view of the developing device.
FIG. 4B is a sectional view of the developing device shown in FIG. 4A.

Now the developing device 20 will be described in detail. FIG. 3 is a sectional side view showing an internal structure of the developing device 20. FIG. 4A is a plan view showing the internal structure of the developing device 20, and FIG. 4B is a sectional front view of the developing device 20. The developing device 20 includes the developing housing 210 (housing) having a box shape having a longer dimension in a specific direction (axial direction of the developing roller 21). The developing housing 210 includes a pair of a first wall 210A and a second wall 210B. The developing housing 210 stores developer. The developing housing 210 has an internal space 220 defined between the first wall 210A and the second wall 210B.

The developing device 20 includes the developing roller 21, a toner supply port 25 (developer receiving port), the first stirring screw 23 and the second stirring screw 24, and a layer regulating member 60. The present embodiment employs a one-component developing method and, therefore, the internal space 220 contains toner including a magnetic material as developer. The toner is circulatively conveyed in the internal space 220 while being stirred. The toner is successively supplied from the developing roller 21 to the photoconductive drum 31 in order to develop an electrostatic latent image. Any other developer, such as a non-magnetic one-component developer and a two-component developer, may alternatively be used in other embodiments.

The developing roller 21 extends between the pair of the first wall 210A and the second wall 210B and has a surface for carrying toner, the developing roller 21 being rotatably supported on the developing housing 210. The developing roller 21 has a cylindrical shape extending in the longitudinal direction of the developing housing 210. The developing roller 21 includes a cylindrical sleeve 21S to be rotationally driven, and a solid cylindrical magnet 21M fixedly disposed in the sleeve 21S in its axial direction (FIG. 3). The sleeve 21S is rotationally driven in the direction of an arrow D31 shown in FIG. 3 by an unillustrated driving mechanism and carries toner on a circumferential surface thereof. The magnet 21M is a stationary magnet disposed in the sleeve 21S and having a plurality of magnetic poles arranged in a circumferential direction of the sleeve 21S. The magnet 21M has four magnetic poles including S1 pole, N1 pole, S2 pole, and N2 pole arranged in the circumferential direction. In FIG. 3, a bold curved line MC surrounding the developing roller 21 shows radial magnetic forces caused by the magnetic poles in the form of a distribution over the circumference of the sleeve 21S. Toner being carried on the sleeve 21S is conveyed to an opening (not shown) provided in the developing housing 210 and then supplied to the photoconductive drum 31 opposite to the opening.

The internal space 220 of the developing housing 210 includes a first conveyance passage 221 (developer conveyance passage) and a second conveyance passage 222 each having a longer dimension in a left-right direction. The developing housing 210 includes a partition plate 22. The partition plate 22 divides the first conveyance passage 221 from the second conveyance passage 222. The partition plate 22 is a vertically standing wall. The first conveyance passage 221 is disposed in the developing housing 210 and spaced from the developing roller 21. The second conveyance passage 222 is disposed between the developing roller 21 and the first conveyance passage 221 and supplies toner to the developing roller 21. The partition plate 22 is shorter than a lateral width of the developing housing 210.

The developing housing 210 includes a first communication passage 223 and a second communication passage 224. The first communication passage 223 and the second communication passage 224 are in the form of openings respectively formed between a left end of the partition plate 22 and the second wall 210B and between a right end of the partition plate 22 and the first wall 210A. Each of the first communication passage 223 and the second communication passage 224 allows communication between the first conveyance passage 221 and the second conveyance passage 222. Toner is delivered from the first conveyance passage 221 to the second conveyance passage 222 through the first communication passage 223. Further, toner is delivered from the second conveyance passage 222 to the first conveyance passage 221 through the second communication passage 224. Consequently, there is established a circulation passage (developer conveyance passage) including the first conveyance passage 221, the first communication passage 223, the second conveyance passage 222 and the second communication passage 224 in the internal space 220.

Toner is conveyed clockwise through the circulation passage as shown in FIG. 4A. With reference to FIG. 4B, the first communication passage 223 and the second communication passage 224 are opened in a rectangular shape extending upward and downward from a first rotary shaft 23*a* of the first stirring screw 23 (a second rotary shaft 24*a* of the second stirring screw 24). In the present embodiment, the second communication passage 224 has an axial length A of 130 mm, the partition plate 22 has an axial length C of 73 mm, and the first communication passage 223 has an axial length B of 20 mm, as an example.

The toner supply port 25 is an opening formed in the top plate 211 of the developing housing 210, and is located near an upper left end of the first conveyance passage 221. The toner supply port 25 is adjacent to the partition plate 22, and functions to receive replenishment toner supplied from the toner container 50 into the first conveyance passage 221 in the internal space 220. In the present embodiment, the toner supply port 25 is a rectangular opening having, in a planar view, a length E of 14 mm and a width of 8 mm, the width perpendicularly intersecting the length E. With reference to FIG. 4A, a distance Z from an upstream end of the first communication passage 223 to a downstream end of the toner supply port 25 is set to 9.5 mm.

The first stirring screw 23 (conveying screw) is disposed in the first conveyance passage 221. The first stirring screw 23 includes the first rotary shaft 23*a*, and a first spiral blade 23*b* (spiral blade) in the form of a spiral protrusion provided (formed) around the first rotary shaft 23*a*. The first stirring screw 23 on the first rotary shaft 23*a* is driven to rotate (in an arrow D33 direction shown in FIG. 3 and an arrow R2 direction shown in FIGS. 4A and 4B) by an unillustrated driving mechanism to convey toner in the direction of an arrow D1 (third conveyance direction) in FIGS. 4A and 4B. Further, with reference to FIG. 3, the first stirring screw 23 rotates downward from an upper position in a zone facing the partition plate 22. In the present embodiment, the first stirring screw 23 is rotated at a speed ranging from 30 to 50 rpm. The first stirring screw 23 conveys toner so that the toner passes under the toner supply port 25 facing the first conveyance passage 221. This allows the first stirring screw 23 to mix new toner flowing from the toner supply port 25 with the toner under conveyance in the first conveyance passage 221 and then deliver the mixed toner to the second conveyance passage 222. In the present embodiment, the first spiral blade 23*b* has an outer diameter L2 of 14 mm, and an axial pitch of 20 mm.

A first paddle 23*c* is disposed at a downstream portion of the toner conveyance direction (arrow direction D1). The first paddle 23*c* is a plate-shaped member disposed on the first rotary shaft 23*a*. The first paddle 23*c* is rotated with the first rotary shaft 23*a* to deliver toner from the first conveyance passage 221 to the second conveyance passage 222 in the direction of an arrow D3 shown in FIG. 4A. In the present embodiment, the first paddle 23*c* has a maximum axial length Y of 19 mm.

The first stirring screw 23 includes a conveying ability reduction shaft portion 26 (conveying ability reduction portion). The conveying ability reduction shaft portion 26 is provided on the downstream side of the toner supply port 25 in the D1 direction and faces the partition plate 22. The conveying ability reduction shaft portion 26 is defined by a specified part of the first rotary shaft 23*a*, the specified part bearing no first spiral blade 23*b*. The conveying ability reduction shaft portion 26 functions to partially reduce the ability of the first stirring screw 23 of conveying toner in the axial direction. In the present embodiment, the conveying ability reduction shaft portion 26 has an axial length X of 10 mm.

Further, the first stirring screw 23 includes a reduction paddle 28. The reduction paddle 28 is provided on the upstream side of the toner supply port 25 in the D1 direction and faces the partition plate 22. The reduction paddle 28 is disposed between adjacent blades of the first spiral blade 23*b*. The reduction paddle 28, similarly to the conveying ability reduction shaft portion 26, also functions to partially reduce the ability of the first stirring screw 23 of conveying toner in the axial direction. With reference to FIG. 4A, an axial distance D from a downstream end of the first conveyance passage 221, namely, the second wall 210B, to an upstream end of the reduction paddle 28 is set to 70 mm.

The second stirring screw 24 is disposed in the second conveyance passage 222. The second stirring screw 24 includes the second rotary shaft 24*a*, and a second spiral blade 24*b* in the form of a spiral protrusion provided (formed) around the second rotary shaft 24*a*. The second stirring screw 24 on the second rotary shaft 24*a* is driven to rotate (in the direction of an arrow D32 shown in FIG. 3 and in the direction of an arrow R1 shown in FIG. 4A) by an unillustrated driving mechanism to convey toner in the direction of an arrow D2 shown in FIG. 4A. Further, with reference to FIG. 3, the second stirring screw 24 rotates upward from a lower position in a zone facing the partition plate 22. In the present embodiment, the second stirring screw 24 is rotated at a speed ranging from 30 to 50 rpm.

The second stirring screw 24 conveys toner in the second conveyance passage 222 and supplies the toner to the developing roller 21. In the present embodiment, the second spiral blade 24*b* has an outer diameter L1 of 14 mm, and an axial pitch of 20 mm. The second stirring screw 24 is disposed horizontally adjacent to and in parallel with the first stirring screw 23. The second stirring screw 24 is disposed in front of and below the developing roller 21. The second stirring screw 24 scoops up toner to the developing roller 21 from a lower position to thereby supply the toner to the sleeve 21S.

On a downstream portion of the second stirring screw 24 in the toner conveyance direction (arrow D2 direction), there is disposed a second paddle 24*c*. The second paddle 24*c* is a plate-like member disposed on the second rotary shaft 24*a*. The second paddle 24*c* is rotated with the second rotary shaft 24*a* to deliver toner from the second conveyance passage 222 to the first conveyance passage 221 in the direction of an arrow D4 shown in FIG. 4A. In the present embodiment, the second paddle 24*c* has an axial length of 20 mm.

The layer regulating member 60 is disposed in front of and above the developing roller 21. The layer regulating member 60 extends in the axial direction of the developing roller 21 and faces the circumferential surface of the developing roller 21 (sleeve 21S). The layer regulating member 60 faces the S1 pole of the magnet 21M of the developing roller 21. The layer regulating member 60 is a plate-like member made of a magnetic material. The layer regulating member 60 has a rectangular shape having, in a sectional view perpendicularly intersecting a rotational axis of the developing roller 21, a rectangular shape having a long dimension in a direction to the developing roller 21. The layer regulating member 60 is disposed in such a manner that an end thereof is spaced from (has a gap with) the sleeve 21S of the developing roller 21. Consequently, there is a layer regulating gap G between the end and the sleeve 21S. The layer regulating member 60 regulates a layer thickness of toner on the developing roller 21 that has been scooped up onto the sleeve 21S by the second stirring screw 24.

The second stirring screw 24 supplies toner to a first position P1 on the circumferential surface of the sleeve 21S, the first position P1 being a vertically lower portion of the sleeve 21S. The layer regulating member 60 regulates a thickness of toner on the sleeve 21S at a second position P2 on the circumferential surface of the sleeve 21S, the second position P2 being a vertically upper portion of the sleeve 21S and being located above the first position P1.

<Regarding Accumulation Portions>

Figure 5:
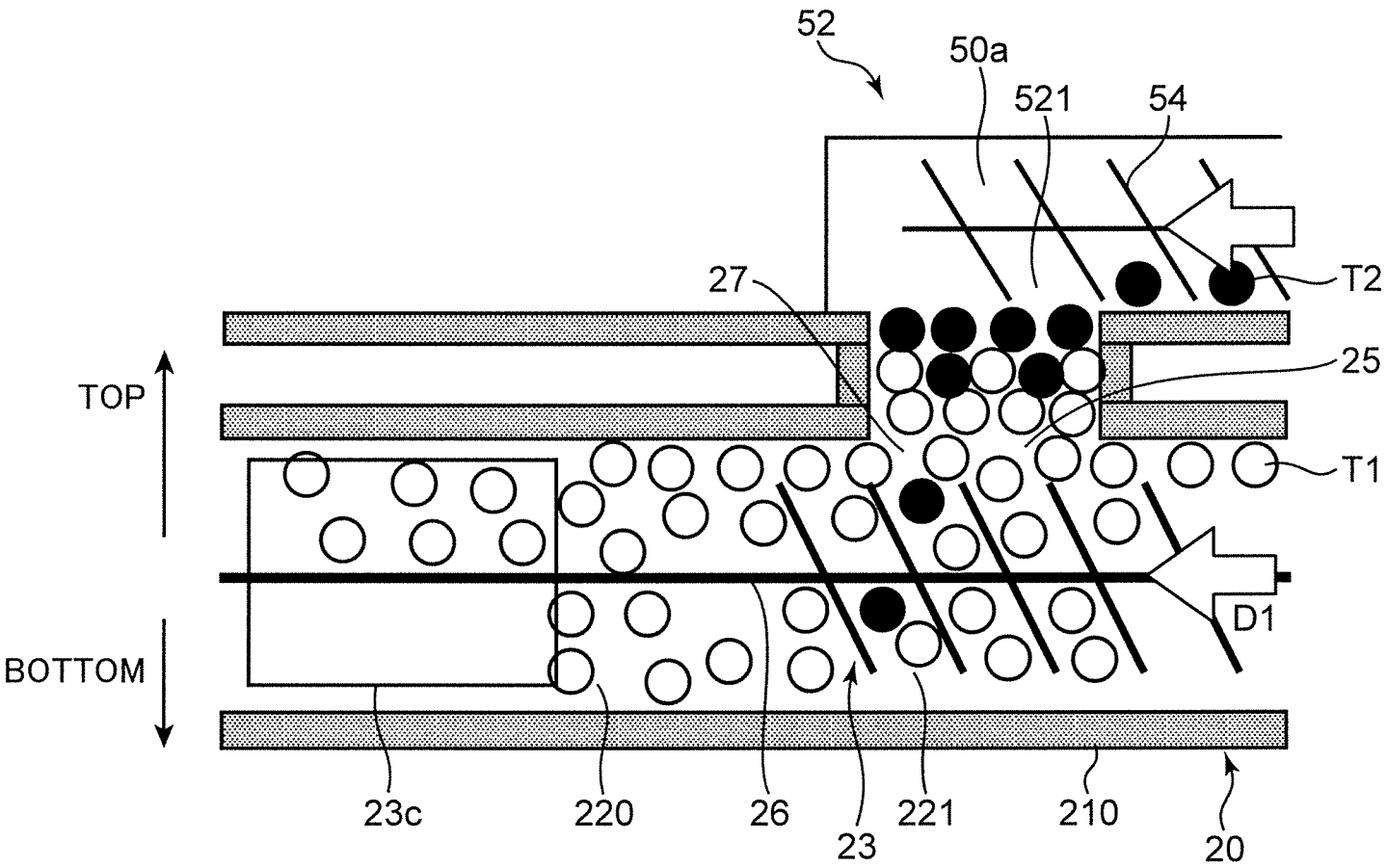
FIG. 5 is a schematic sectional view illustrating supply of toner to the developing device.

Now, there will be described a flow of toner in the developing device 20 according to the present embodiment, the toner being newly supplied through the toner supply port 25. FIG. 5 is a sectional view of the vicinity of the toner supply port 25 provided in the developing device 20 and a toner discharge port 521 provided in the toner container 50. It should be noted that, for descriptive purposes, FIG. 5 shows the arrangement of the toner container 50 that is horizontally rotated by 90 degrees. Actually, the rotatory member 54 in the toner container 50 extends in a direction perpendicularly intersecting the drawing sheet surface, in other words, the rotary shaft 54 in the toner container 50 perpendicularly intersects the first stirring screw 23.

The toner container 50 is disposed above the toner supply port 25 of the developing housing 210. The toner container 50 includes a toner conveyance passage 50*a* for allowing toner to pass therethrough, the rotary member 54, and the toner discharge port 521.

The toner discharge port 521 is provided in a bottom surface of the toner container 50 and corresponds to the toner supply port 25 of the developing device 20. The rotary member 54 includes a rotary shaft 541, and a first conveying member 55 and a second conveying member 56 to be rotated with the rotary shaft 541 (see FIG. 8), and conveys replenishment toner in the toner conveyance passage 50*a* to the toner discharge port 521, as described later. Toner that is falling from the toner discharge port 521 passes through the toner supply port 25 and is thereby supplied to the developing device 20.

Replenishment toner T2 supplied through the toner discharge port 521 of the toner container 50 falls into the first conveyance passage 221 to be mixed with existing toner T1 and then the mixed toners T1 and T2 are conveyed in the arrow D1 direction by the first stirring screw 23. At this time, the toners T1 and T2 are stirred and charged.

The first stirring screw 23 includes the above-described conveying ability reduction shaft portion 26 on the downstream side of the toner supply port 25 in the toner conveyance direction. The conveying ability reduction shaft portion 26 does not have an ability of conveying developer in the axial direction of the first rotary shaft 23*a*. Therefore, toner that is flowing into the first conveyance passage 221 through the toner supply port 25 begins to accumulate due to the conveying ability reducing portion 26. The toner accumulates in an area on the immediate upstream side of the conveying ability reducing portion 26, the area extending to a position where the toner supply port 25 faces the first conveyance passage 221. As a result, a toner accumulation portion 27 appears near the inlet of the toner supply port 25.

When the amount of toner in the internal space 220 has increased due to the supply of the replenishment toner T2 though the toner supply port 25, accumulated toner in the accumulation portion 27 covers (closes) the toner supply port 25, so that further toner supply is prevented. Thereafter, as the accumulated toner in the accumulation portion 27 decreases in amount due to consumption of toner in the internal space 220 by the developing roller 21, the amount of toner covering the toner supply port 25 decreases such that a gap appears between the accumulation portion 27 and the toner supply port 25. This allows inflow of the replenishment toner T2 into the internal space 220 through the toner supply port 25 again. In this manner, the present embodiment employs a volume replenishment type toner supply method in which the amount of replenishment toner to be received is adjusted in accordance with a decrease in the amount of accumulated toner in the accumulation portion 27, namely, by making use of change in the volume of the accumulated toner.

Further, in the present embodiment, the reduction paddle 28 (upstream-side conveying ability reduction portion) is disposed on the upstream side of the toner supply port 25 in the toner conveyance direction, as described above. A toner accumulation portion also appears on the upstream side of the toner supply port 25 in the conveyance direction as a result of circular movement of the reduction paddle 28. The accumulation portion functions to cause toner to slowly flow therethrough to thereby partially close the part of the first conveyance passage 221 that is located on the upstream side of the toner supply port 25. This prevents replenishment toner flowing into the first conveyance passage 221 through the toner supply port 25 from advancing further upstream than the toner supply port 25.

<Structure of Toner Container>

Figure 6:
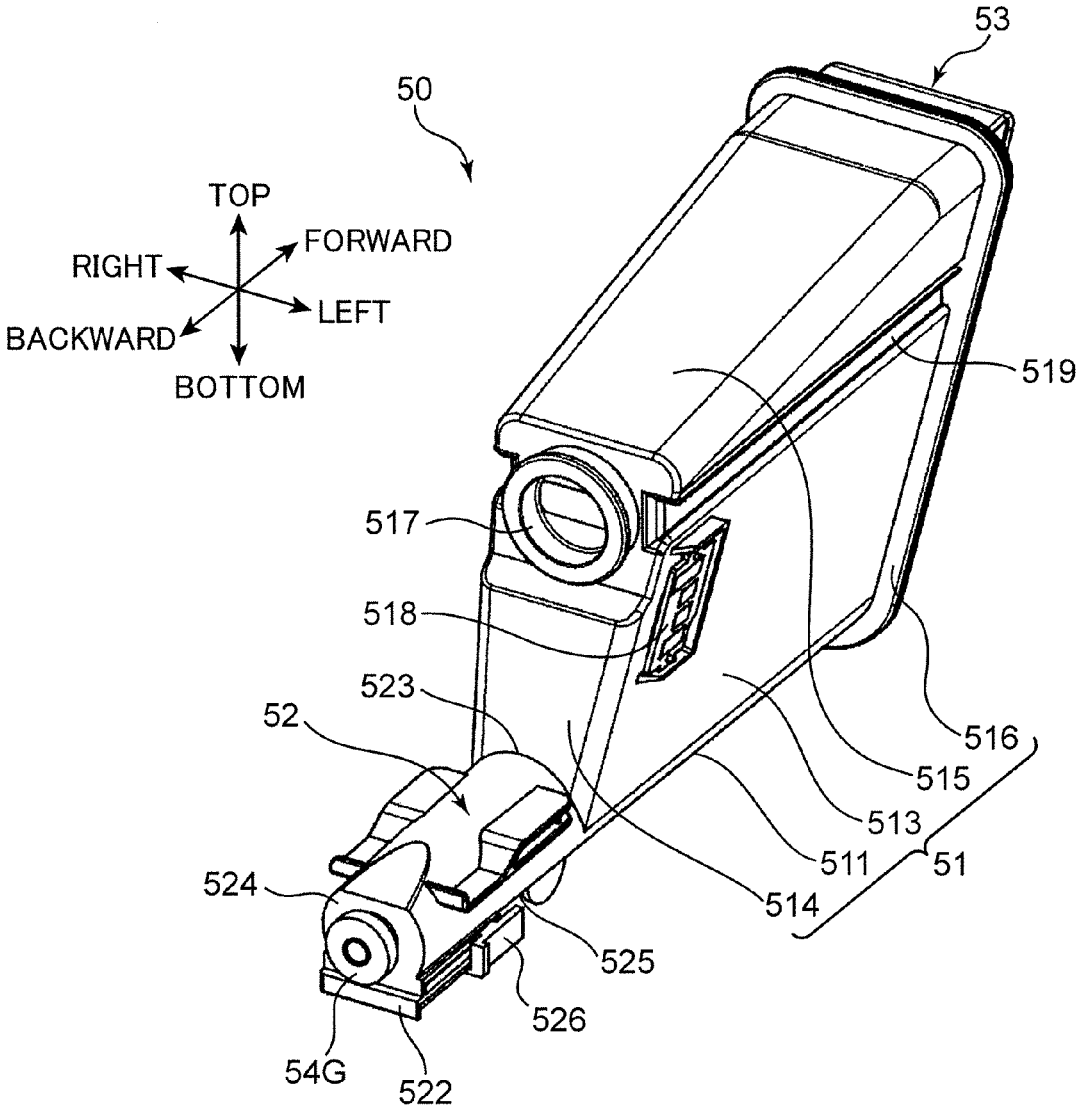
FIG. 6 is a perspective view of a developer container according to the first embodiment of the present disclosure.
Figure 7:
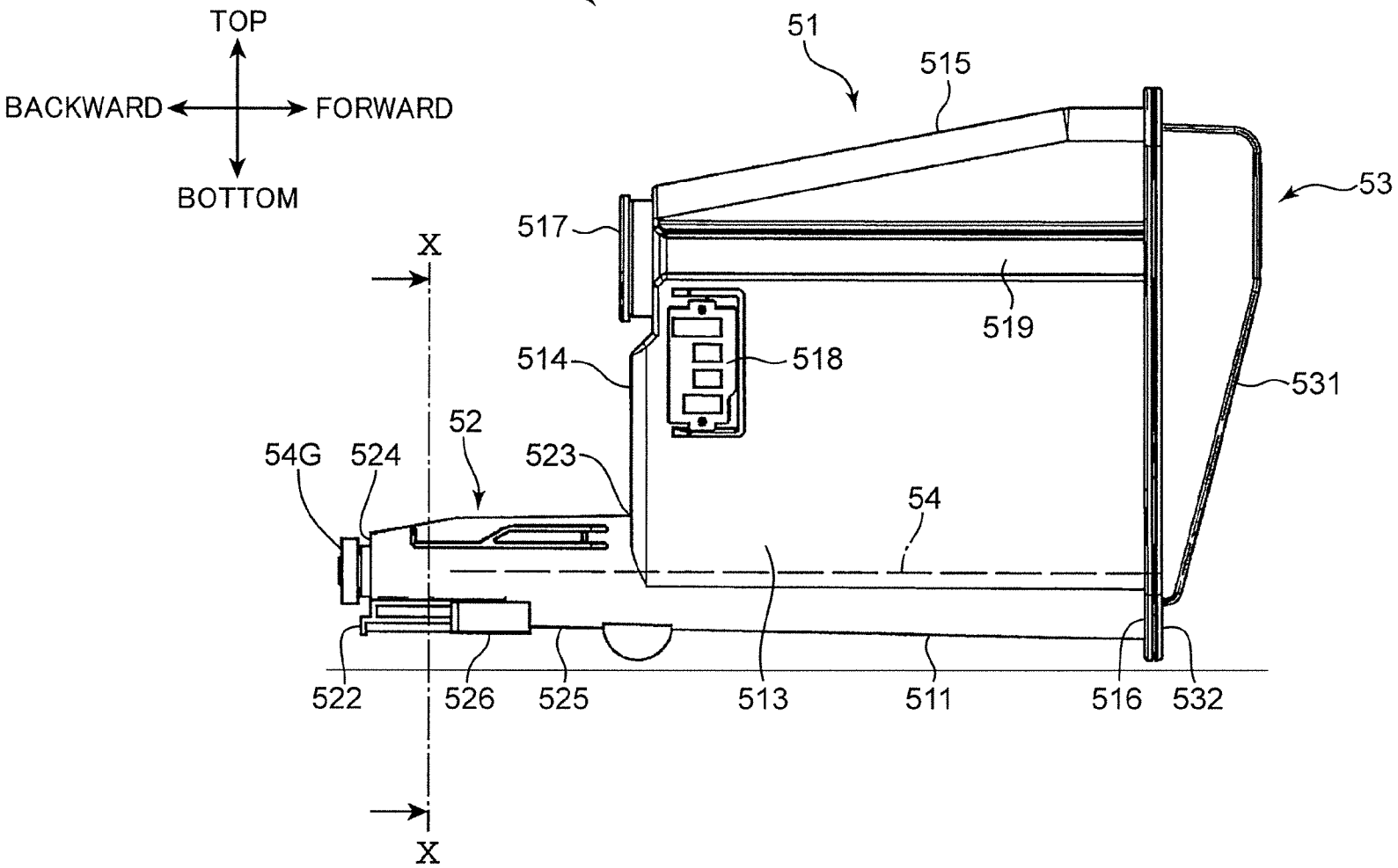
FIG. 7 is a side view of the developer container.
Figure 8:
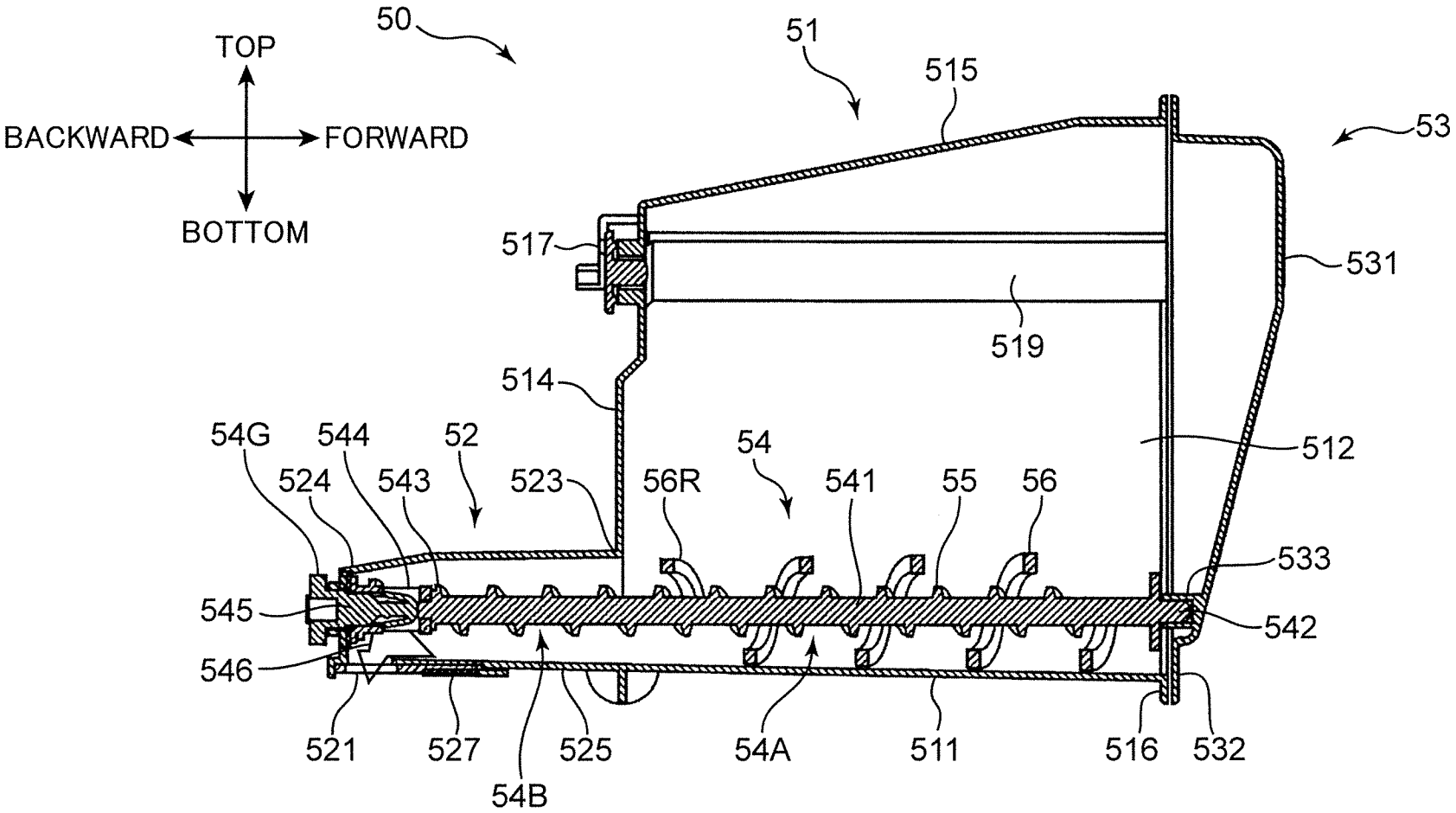
FIG. 8 is a sectional side view of the developer container.
Figure 9:
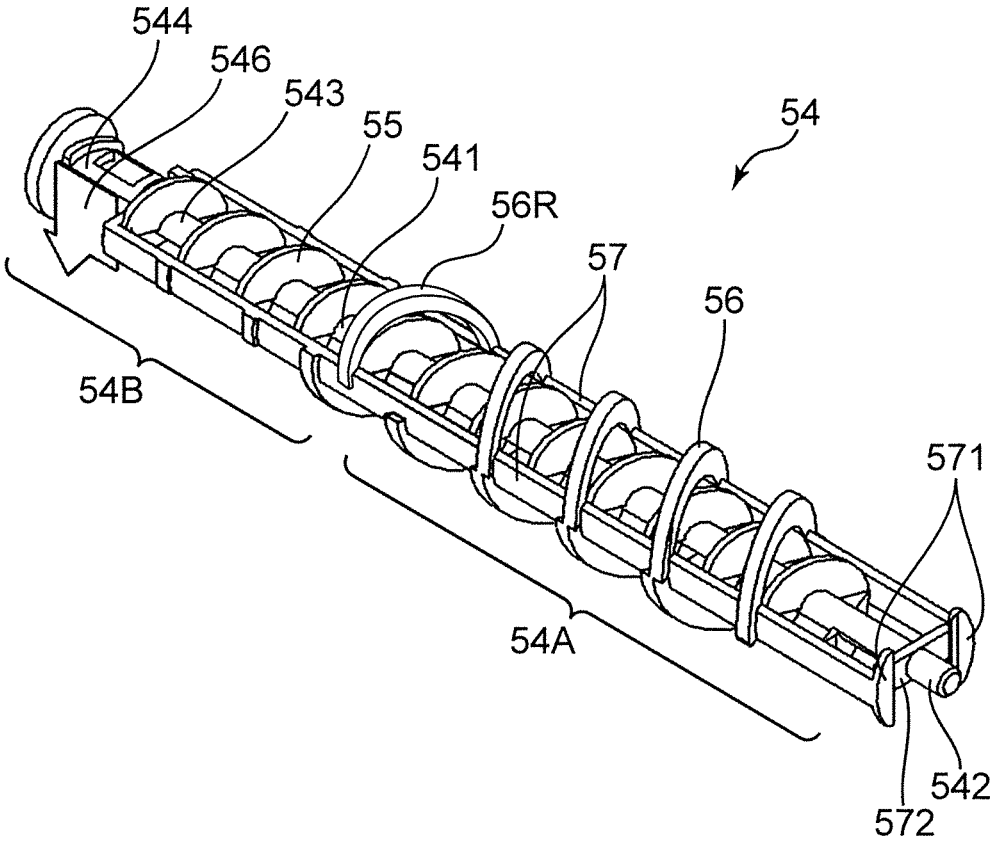
FIG. 9 is a perspective view of a rotary member according to the first embodiment of the present disclosure.

Now the structure of the toner container 50 according to the present embodiment will be further described in detail. FIGS. 6 and 7 respectively show a perspective view and a side view of the toner container 50 shown independently. FIG. 8 is a sectional view of the toner container 50 taken along the rotary shaft 541. FIG. 9 is a perspective view of the rotary member 54 of the toner container 50.

The developing device 20 and the toner container 50 are assembled in such a manner that the toner supply port 25 (FIGS. 4A and 4B) of the developing housing 210 and the toner discharge port 521 of the toner container 50 vertically face each other. The toner container 50 is attached to and detached from the developing device 20 in a direction perpendicularly intersecting the longitudinal direction of the developing housing 210, as described above. The toner container 50 has, in a top view, a housing shape having a long dimension in a specific direction. Therefore, a structure formed by attaching the toner container 50 to the developing device 20 has a substantial L-shape in a top view.

On an upper surface of the top plate 211 of the developing housing 210, there is disposed a development shutter plate (not shown) which is slidably movable in the left-right direction so as to cover the toner supply port 25 from the above. The development shutter plate is continually biased in the left direction by an unillustrated biasing spring.

With reference to FIGS. 6 and 7, the cylinder section 52 of the toner container 50 is attached with a pressing plate 522 on a bottom of a leading end (i.e., the other end 524). The cylinder section 52 is provided with a container gear 54G on an outside surface of the leading end thereof, the container gear 54G being adapted for transmitting a driving force to the rotary member 54.

When the toner container 50 is attached to the developing device 20, the cylinder section 52 of the toner container 50 goes into the toner supply port 25 from the front to the rear. At this time, the pressing plate 522 of the toner container 50 comes into contact with the development shutter plate closing the toner supply port 25 to thereby move the development shutter plate rightward. When the cylinder section 52 of the toner container 50 has advanced to a specific position, the toner supply port 25 is completely opened.

Further, with reference to FIG. 8, the toner container 50 includes the container housing 51, the cylinder section 52, the cover member 53 and the rotary member 54. The container housing 51 includes, in order to define a space for storing replenishment toner (developer), a bottom wall 511 having a semicircular cross section, a first side wall 512 (FIG. 10) extending upward from one end edge of the bottom wall 511, a second side wall 513 extending upward from the other end edge of the bottom wall 511 and opposite to the first side wall 512, a third side wall 514 connecting the first side wall 512 and the second side wall 513 at an end edge of the cylinder section 52, a top wall 515 connecting upper end edges of the first side wall 512 and the second side wall 513, and a first flange 516 formed on an end edge of the container housing 51 on an end side facing the cover member 53. The container 51 has an opening in the end side formed with the first flange 516.

The container housing 51 has a vertically elongated external shape in which the opposite distance between the first side wall 512 and the second side wall 513 is smallest on the bottom wall 511 and becomes larger as advancing in an upward direction away from the bottom wall 511. Each of the first side wall 512 and the second side wall 513 is a flat plate and has a straight inner surface in the cross section.

An upper part of the third side wall 514 is attached with a cap 517 for closing an opening for filling toner into the container housing 51. The second side wall 513 is attached with a wireless tag 518 recorded with management information of the toner container 50. Further, in the vicinities of respective upper ends of the first side wall 512 and the second side wall 513, there is provided a pair of grooves 519 extending in parallel with the bottom wall 511. When the toner container 50 is mounted to the main housing 10, the toner container 50 is guided by an engagement of the grooves 519 with an unillustrated guide member of the main housing 10.

The cylinder section 52 joins the bottom wall 511 and projects from the third side wall 514. The cylinder section 52 has one end 523 joining a lower end of the third side wall 514, which allows communication between an internal space of the container housing 51 and an internal space of the cylinder section 52. The other end 524 of the cylinder section 52 is the leading end of the protruding cylinder section, and the container gear 54G lies further outward from the other end 524. The cylinder section 52 has a bottom surface 525 flush with the bottom wall 511 of the container housing 51. Consequently, there is a trough-like portion having a semicircular cross section which extends from the first flange 516 to the other end 524. The cylinder section 52 has an inner wall surface having a circular shape in a radial cross-section of the rotary shaft 541, and is slightly tapered from the one end 523 to the other end 524.

As described above, the cylinder section 52 is formed with the toner discharge port 521 and attached to the developing device 20. Consequently, the toner discharge port 521 faces the toner supply port 25. The toner discharge port 521 is a drop port formed in the bottom surface 525 (lower surface) of the cylinder section 52. The bottom surface 525 is provided with an engaging portion 526 to be brought into engagement with a part of the developing housing 210 in the attachment mentioned above. Toner that is stored in the container housing 51 is fed to the cylinder section 52 by a rotational drive of the rotary member 54 described later, and then discharged through the toner discharge port 521.

As shown in FIG. 8, the toner discharge port 521 is formed near the other end 524 in the bottom surface 525. There is a shutter plate 527 (shutter) attached on the underside of the bottom surface 525 of the cylinder section 52, the shutter plate 527 being slidably movable in a longitudinal direction of the cylinder section 52 (axial direction of the rotary shaft 541) under the toner discharge port 521. The shutter plate 527 is always biased in a direction toward the other end 524 by an unillustrated biasing member so as to cover the toner discharge port 521. On the other hand, when the cylinder section 52 is attached to the developing device 20, a part of the developing housing 210 comes into contact with the shutter plate 527 to cause it to slide in a direction toward the one end 523. FIG. 8 shows the shutter plate 527 located at a retreated position to allow the toner discharge port 521 to open. In this manner, the shutter plate 527 slides to thereby close and open the toner discharge port 521. The shutter plate 527 and the above-mentioned engaging portion 526 are integrally formed into one body.

The cover member 53 covers the end side opening of the container housing 51, and includes a cover body 531 having a concave shape, and a second flange 532 provided in the rim of the cover body 531 and facing the first flange 516. The cover body 531 has an inner surface having a lower end provided with a shaft support 533 for rotatably supporting a first end 542 of the rotary shaft 541 of the rotary member 54 described later. In a state that the first end 542 is placed in the shaft support 533, the second flange 532 is welded on the first flange 516.

The rotary member 54 extends from the container housing 51 into the cylinder section 52 over their bottom walls, and is driven to rotate around its axis to convey toner from the container housing 51 to the toner discharge port 521. As shown in FIGS. 8 and 9, the rotary member 54 includes the rotary shaft 541, and the first conveying member 55, the second conveying member 56, and a pair of dispersing members 57 integrally rotatable with the rotary shaft 541.

The rotary shaft 541 extends in an extending direction (a longitudinal direction) of the bottom wall 511, and has opposite ends, i.e., the first end 542 and a second end 543. The first end 542 is rotatably supported on the shaft support 533 of the cover member 53. The second end 543 is integrally attached with a cylindrical holding piece 544. The container gear 54G and the rotary shaft 541 are integrated with each other by fitting a stem 545 of the container gear 54G into the cylindrical holding piece 544. The stem 545 is rotatably supported on the other end 524 of the cylinder section 52. In this manner, the rotary shaft 541 is rotatably supported on the container housing 51 and the cylinder section 52.

The cylindrical holding piece 544 is attached with a resilient film member 546 (resilient member) facing the toner discharge port 521 for feeding toner into the toner discharge port 521. The film member 546 is essentially made of a thin rectangular PET film, and is attached to a circumferential surface of the cylindrical holding member 544, and stretches in a direction perpendicularly intersecting the axial direction of the rotary shaft 541. The film member 546 circularly moves with rotation of the rotary shaft 541 to cause toner existing around the other end 524 of the cylinder section 52 to flow into the toner discharge port 521.

The first conveying member 55 is integrally formed with the rotary shaft 541, and spirally protrudes from a circumferential surface of the rotary shaft 541. The second conveying member 56 is disposed around the circumferential surface of the rotary shaft 541 and has a hollow spiral shape having a gap relative to the rotary shaft 541 and the first conveying member 55. In other words, the second conveying member 56 is disposed around the circumferential surface of the rotary shaft 541 so as to lie at a position radially further outward than the first conveying member 55. The pair of dispersing members 57 has a rod shape having substantially the same length as the rotary shaft 541 and is disposed in parallel with the rotary shaft 541, the dispersing members 57 bearing the opposite ends of the second conveying member 56. One of the dispersing members 57 is shifted from the other 180 degrees in a circumferential direction of the rotary shaft 541.

In other words, the second conveying member 56 includes a plurality of conveying pieces having a semicircular arch shape. The arch-shaped conveying pieces are integrated by means of the pair of dispersing members 57 to constitute the spiral second conveying member 56 which defines an annular space around a center axis thereof. An inner diameter of the annular space of the second conveying member 56 is larger than an outer diameter of the spiral first conveying member 55. In the rotary member 54 according to the present embodiment, the rotary shaft 541 having the first conveying member 55 on the circumferential surface thereof passes through the annular space coaxially with the second conveying member 56. The first conveying member 55 and the second conveying member 56 have the opposite spiral lead directions.

On the other side closer to the second end 543 (on the cylinder section 52 side) of the second conveying member 56, there is provided a spiral piece 56R including a conveying piece having a semicircular arch shape. The spiral piece 56R has substantially the same size as the arch-shaped spiral pieces of the second conveying member 56. However, the spiral piece 56R is attached on the pair of opposite dispersing members 57 and its spiral lead direction is opposite to that of the arch-shaped conveying pieces of the second conveying member 56.

The dispersing members 57 in pair are connected to each other at their respective ends 571 via a connecting piece 572. The connecting piece 572 is fixedly attached to the vicinity of the first end 542 of the rotary shaft 541 at a central portion thereof. Though not shown in FIG. 9, there is another similar connecting piece disposed on the other side closer to the second end 543. In other words, the rotary shaft 541, the second conveying member 56, and the dispersing members 57 are integrated by means of the connecting piece 572, which allows the second conveying member 56 and the dispersing members 57 to integrally rotate upon rotation of the rotary shaft 541.

The above-described rotary shaft 541 extends in the container housing 51 and the cylinder section 52, and includes a first part 54A located in the container housing 51 and a second part 54B located in the cylinder section 52 as shown in FIG. 9. The first conveying member 55 extends substantially entirely in the axial direction of the rotary shaft 541. In other words, the first conveying member 55 is formed on the circumferential surface of the rotary shaft 541 over both the first part 54A and the second part 54B. The first conveying member 55 may alternatively be so configured as to extend at least over the second part 54B of the rotary shaft 541. On the other hand, the second conveying member 56 extends only over the first part 54A. The spiral piece 56R is disposed in the first part 54A near a boundary of the second part 54B, and meets an end of the second conveying member 56. The dispersing member 57 extends over both the first portion 54A and the second part 54B.

When the container gear 54G receives a driving force for rotating the rotary shaft 541 in a specific rotational direction, the first conveying member 55 and the second conveying member 56 exert a force for conveying toner in directions in accordance with their respective spiral lead directions. The second conveying member 56 conveys toner in a direction from the container housing 51 to the cylinder section 52 (toner discharge port 521) (hereinafter, referred to as a second conveyance direction). In other words, the second conveying member 56 conveys toner in a direction from the first end 542 to the second end 543 of the rotary shaft 541. In contrast, the first conveying member 55 conveys toner in a direction of returning the toner from the cylinder section 52 to the container housing 51 (hereinafter, referred to as a first direction). In other words, the first conveying member 55 conveys toner in a direction from the second end 543 to the first end 542 of the rotary shaft 541.

On the other hand, the dispersing members 57 function to disperse toner under conveyance by the first screw member 55 and the second conveying member 56 radially outward of the rotary shaft 541. Specifically, the dispersing members 57 disperse toner existing around a specific portion of toner radially outward, the specific portion being imparted with a propulsive force by the first conveying member 55 or the spiral pieces of the second conveying member 56. This promotes movement of toner in the first conveyance direction or the second conveyance direction. Therefore, the second conveying member 56 does not need to extend in the second part 54B in order to lead toner to the toner discharge port 521. Further, a part of toner that has not been discharged through the toner discharge port 521 is satisfactorily returned to the container housing 51 by the first conveying member 55. In particular, the second conveying member 56, which does not extend in the second part 54B, prevents toner from being excessively conveyed in the second conveyance direction in the cylinder section 52 having a small space for accommodating toner. This contributes to prevent aggregation of toner.

The spiral piece 56R has the spiral lead direction opposite to that of the second conveying member 56, and therefore conveys toner in the first conveyance direction. The spiral piece 56R functions to produce, in the vicinity of the boundary of the container housing 51 in the cylinder section 52, a conveying force of positively returning toner from the cylinder section 52 to the container housing 51.

<Details of Resilient Member>

Now the structure of the film member 546 according to the first embodiment of the present disclosure will be further described in detail. As described above, in the present embodiment, upon attachment of the toner container 50 to the developing device 20, the toner discharge port 521 faces the toner supply port 25. At this time, as shown in FIG. 5, the toner discharge port 521 and the toner supply port 25 are vertically spaced at a predetermined interval. This is to allow the shutter plate 527 to slide to cover the toner discharge port 521. In this manner, any conveying member for conveying toner is not disposed between the container housing 51 and the toner supply port 25, and toner moves downward in free fall. Consequently, toner is likely to accumulate between the toner discharge port 521 and the toner supply port 25 to permit aggregation (blocking) of toner.

Further, the present embodiment employs the volume replenishment type toner supply method as described above. When a large amount of toner is stored in the developing housing 210 of the developing device 20, the toner supply port 25 is covered by the toner located thereunder. If, in this state, replenishment toner is supplied downward through the toner discharge port 521 with rotation of the rotary member 54, aggregation of toner is liable to occur between the toner discharge port 521 and the toner supply port 25.

In particular, to decrease the number of driving mechanisms for driving rotary members of developing devices 20 and toner containers 50 as many as possible, it is appreciated to use a common driving mechanism which rotates a developing roller 21, a first stirring screw 23, and a second stirring screw 24 of a developing device 20, and a rotary member 54 of a toner container 50 in synchronism with one another. In this case, the rotary member 54 is synchronously rotated with the first stirring screw 23 regardless of the amount of toner in the developing housing 210. Consequently, aggregation of toner will be seen to be further liable to occur between the toner discharge port 521 and the toner supply port 25.

In order to solve this problem, it is appreciated to dispose an elastic member (not shown) radially extending from the first stirring screw 23 (FIG. 5). The elastic member protrudes upward out of the toner supply port 25 periodically because rotating together with the first stirring screw 23. This can prevent aggregation of toner between the toner discharge port 521 and the toner supply port 25. However, in this case, the elastic member is liable to push back toner flowing from the toner discharge port 521 into the developing housing 210 through the toner supply port 25 to the toner container 50. Consequently, replenishment toner is unlikely to be consistently supplied to the developing device 20, which may cause a reduced image density. Further, the toner that is pushed back to the toner container 50 from the developing device 20 deteriorates in the developing device 20 little by little, and consequently the pushed-back toner has a different electrification characteristic from that of toner stored in the toner container 50. If those toners having different electrification characteristics are mixed and supplied to the developing device 20, toner in the developing housing 210 is liable to have an unstable electrification characteristic, which may cause a toner fogging on an image.

In the present embodiment, the toner container 50 includes the above-described film member 546 in order to consistently supply toner to the developing device 20 while preventing the above-described toner aggregation.

Figure 10:
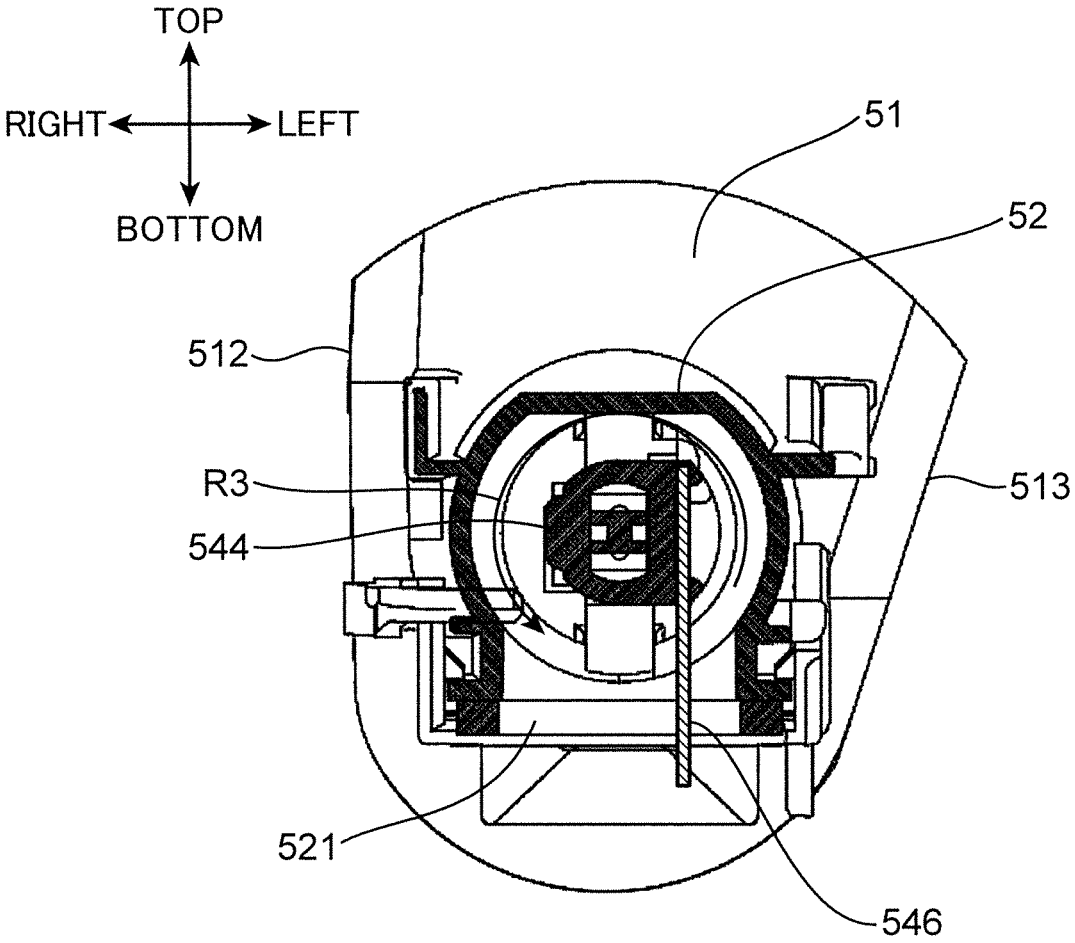
FIG. 10 is a sectional view taken along the line X-X in FIG. 7.
Figure 11:
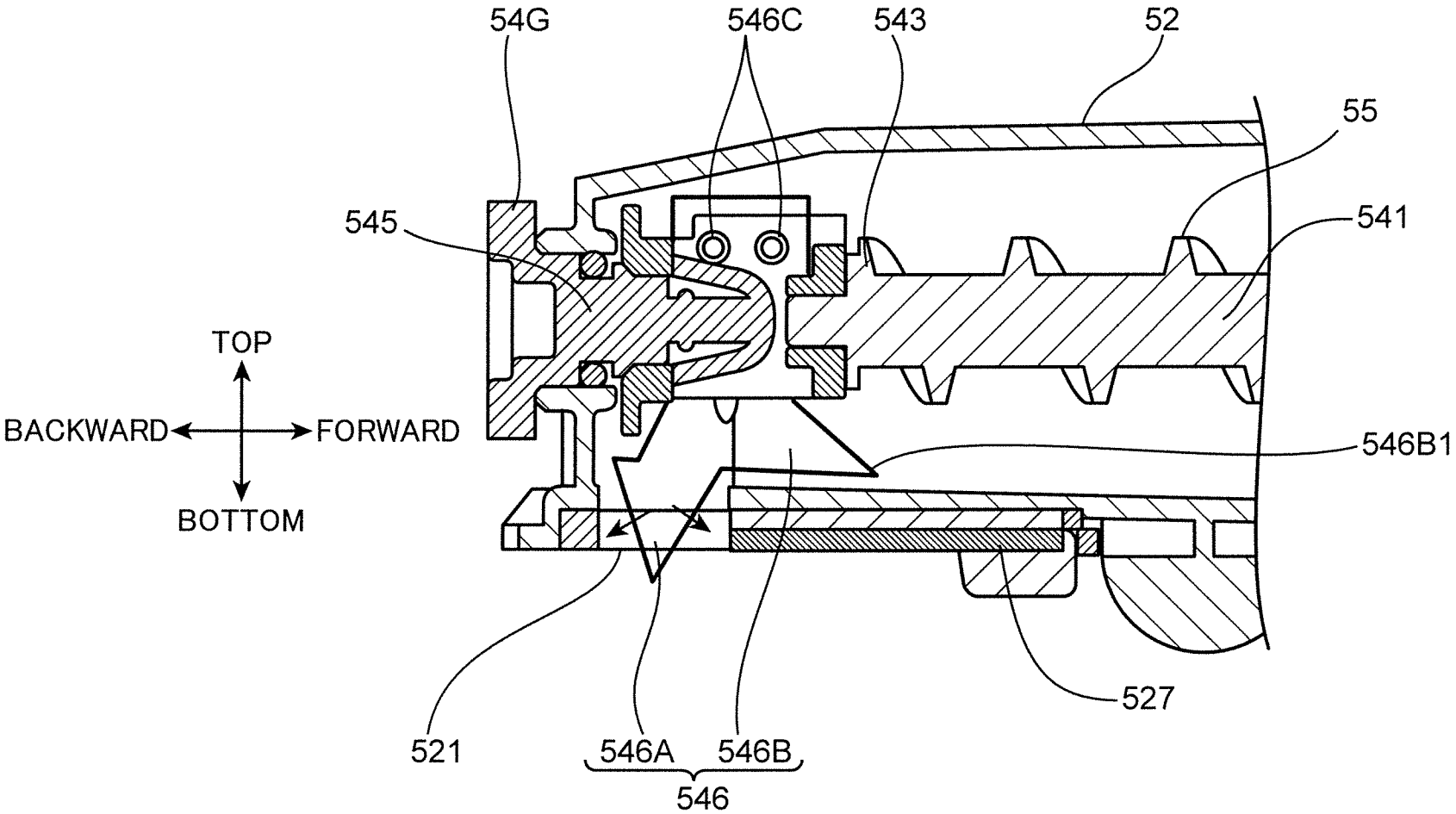
FIG. 11 is a sectional view of the vicinity of a developer discharge port of the developer container.
Figure 12:
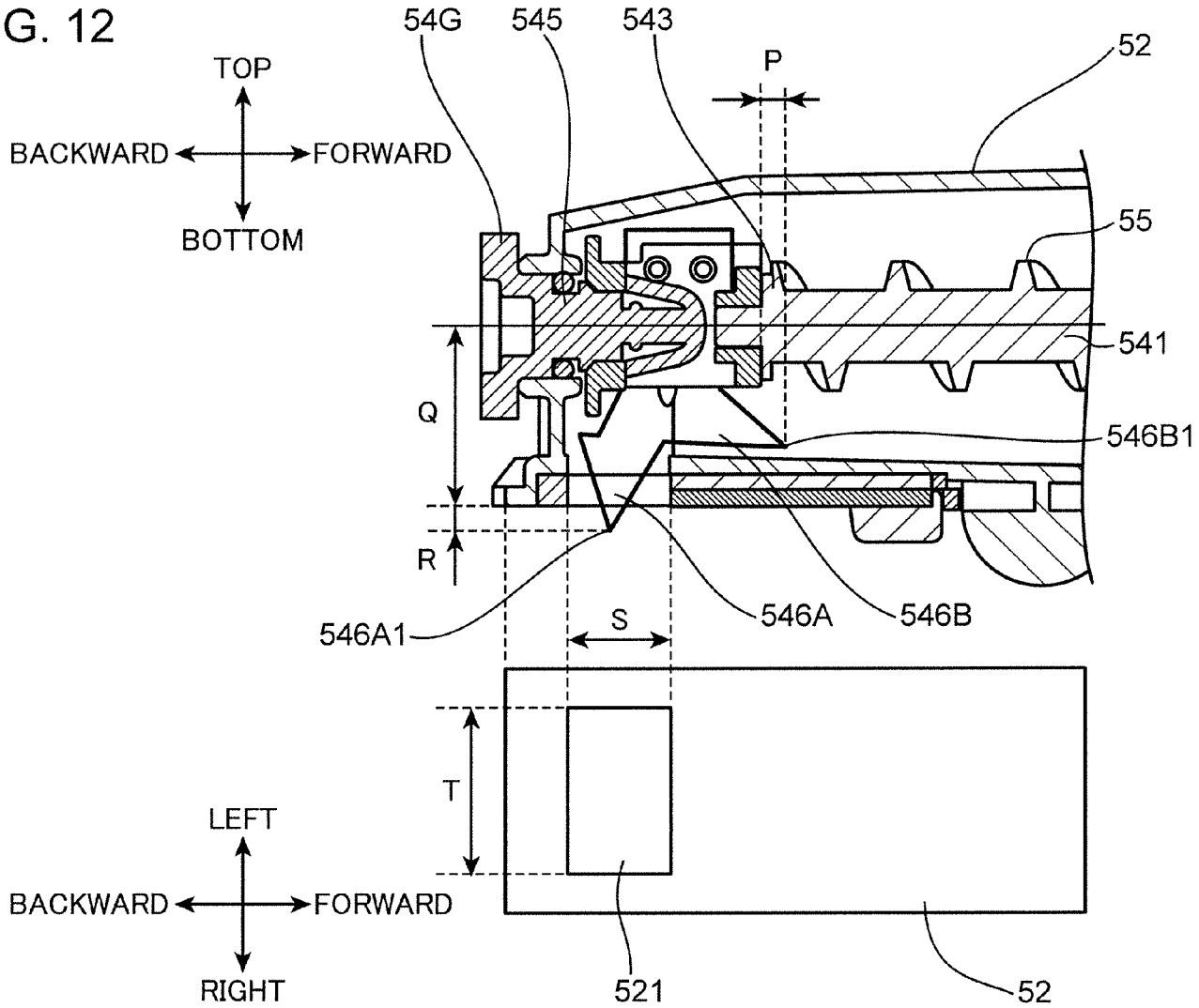
FIG. 12 is a sectional view of the vicinity of the developer discharge port of the developer container.

FIG. 10 is a sectional rear view of the vicinity of the toner discharge port 521 of the toner container 50. FIG. 10 is a sectional view taken along the line X-X in FIG. 7. FIGS. 11 and 12 are a sectional left side view of the vicinity of the toner discharge port 521 of the toner container 50. FIGS. 11 and 12 are a sectional view of the toner container 50 taken along the axis of the rotary shaft 541. FIG. 12 also includes a bottom view of the cylinder section 52, which is arranged below the sectional view. In FIG. 12, P denotes a width of an area where the first conveying member 55 and the film member 546 axially overlap. Q denotes a distance from the rotational axis of the rotary shaft 541 to the bottom of the toner discharge port 521. R denotes a length of a protruding tip end 546A1 of the film member 546 protruding out of the toner discharge port 521, the tip end 546A1 being described later. S denotes an axial opening length of the toner discharge port 521 having a rectangular shape. T denotes a lateral opening width (measured in a direction perpendicularly intersecting the axial direction) of the toner discharge port 521.

With reference to FIGS. 10 and 11, the film member 546 radially projects from the second part 54B of the rotary shaft 541 and faces the toner discharge port 521. The film member 546 extends from the circumferential surface of the cylindrical holding piece 544 of the rotary shaft 541 and is located at a position shifted from the rotational axis of the cylindrical holding piece 544 by a predetermined distance.

The film member 546 includes a stretching portion 546A, a conveying portion 546B, and a fixing portion 546C. The stretching portion 546A and the conveying portion 546B radially extend from the cylindrical holding piece 544.

Specifically, the stretching portion 546A constitutes a part of the film member 546 that faces the toner discharge port 521. The stretching portion 546A tapers radially outward. In particular, in the present embodiment, the stretching portion 546A of the film member 546 has, in the sectional view shown in FIG. 11, a triangular shape tapering radially outward. The protruding tip end 546A1 (FIG. 12) (tip end) of the stretching portion 546A has an acute angle. In other words, the triangular shape has an acute angle at its tip end.

On the other hand, the conveying portion 546B joins the stretching portion 546A at the upstream side in the second conveyance direction, and circularly moves with rotation of the rotary shaft 541 in the cylinder section 52. As shown in FIG. 11, the conveying portion 546B has an oblique end extending radially outward and upstream in the second conveyance direction. In addition, as shown in FIG. 12, an upstream end (conveyance upstream end 546B1) of the conveying portion 546B is located further upstream than the downstream end (second end 543) of the first conveying member 55 in the second conveyance direction. Further, a radially outer end edge of the conveying portion 546B extends in the axial direction of the rotary shaft 541. The outer end edge is spaced from the inner surface of the cylinder section 52 at a predetermined interval. Therefore, the outer end edge of the conveying portion 546B moves on an inner circular orbit than the inner surface of the cylinder section 52 with rotation of the rotary shaft 541.

The fixing portion 546C is located radially opposite to the stretching portion 546A and the conveying portion 546B in the film member 546. The fixing portion 546C includes a plurality of openings formed in the film member 546, and these openings are fitted on projections (not shown) projecting from the cylindrical holding pieces 544. This allows the film member 546 to rotate integrally with the cylindrical holding piece 544 and the rotary shaft 541.

With reference to FIG. 10, as the film member 546 circularly moves in the direction of an arrow R3 with rotation of the cylindrical holding piece 544 (rotation shaft 541), the protruding tip end 546A1 (FIG. 12) of the stretching portion 546A rubs the inner surface of the cylinder section 52 and then protrudes out of the toner discharge port 521 (FIG. 11) radially outward from the cylinder section 52. This allows the film member 546 making the circular movement with the rotation of the rotary shaft 541 to discharge toner downward through the toner discharge port 521, the toner having been conveyed from the container housing 51 to the toner discharge port 521 of the cylinder section 52 by the rotary member 54. The discharged toner flows into the developing housing 210 through the toner supply port 25 of the developing device 20. At this time, the protruding tip end 546A1 of the film member 546 comes to protrude between the toner discharge port 521 and the toner supply port 25. This allows the protruding tip end 546A1 to disperse toner between the toner discharge port 521 and the toner supply port 25 to thereby prevent aggregation of the toner. Therefore, toner can be consistently supplied from the toner container 50 to the developing device 20.

In the state that the protruding tip end 546A1 of the film member 546 protrudes out of the toner discharge port 521, the other part of the film member 546 is not in contact with the inner surface of the cylinder section 52. Specifically, as described above, the outer end edge of the conveying portion 546B is spaced from the inner surface of the cylinder section 52 at a predetermined interval. Consequently, when the protruding tip end 546A1 of the film member 546 leaves the inner surface of the cylinder section 52, an elastic force of the film member 546 is released, so that the protruding tip end 546A1 springs to protrude out of the toner discharge port 521. This allows the protruding tip end 546A1 of the film member 546 to strongly stir toner existing between the toner discharge port 521 and the toner supply port 25 to thereby prevent the toner from forming blocks.

Further, the stretching portion 546A has a triangular shape tapering radially outward. This allows toner pushed by the stretching portion 546A, in the state that the protruding tip end 546A1 protrudes out of the toner discharge port 521, to axially moves, as shown in arrows in FIG. 11. This can prevent toner existing between the toner discharge port 521 and the toner supply port 25 from being excessively pressed toward the inside of the developing housing 210. In particular, because the present embodiment employs the volume replenishment type toner supply method, if the accumulation portion 27 (FIG. 5) receives a strong pressing force by way of the compacted toner in the toner supply port 25, the accumulation portion 27 will collapse. In this case, an excess of toner is liable to be supplied to the inside of the developing housing 210. In view of the above, the stretching portion 546A has a tapering shape to prevent collapse of the accumulation portion 27. Consequently, the volume replenishment type toner supply can be consistently maintained.

On the other hand, if the toner container 50 is detached from the developing device 20 in the state that the protruding tip end 546A1 protrudes downward out of the toner discharge port 521, the protruding tip end 546A1 may be pinched between the shutter plate 527 and the bottom surface 525 of the cylinder section 52 because of sliding of the shutter plate 527. In this case, a gap is liable to appear around the toner discharge port 521 to cause toner leakage. However, in the present embodiment, because the stretching portion 546A has a tapering triangular shape, when the shutter plate 527 is closed, the shutter plate 527 comes into contact with the oblique end of the stretching portion 546A to cause the stretching portion 546A to curve in a circumferential direction of the rotary shaft 541 and come in the cylinder section 52. Consequently, the stretching portion 546A can be prevented from disturbing movement of the shutter plate 527 and from being pinched between the shutter plate 527 and the cylinder section 52.

In particular, in the case that the stretching portion 546A has a triangular shape including a straight side, the stretching portion 546A of the film member 546 can smoothly come in the cylinder section 52 when the shutter plate 527 comes in contact with the stretching portion 546A. In addition, the stretching portion 546A of the film member 546 has an acute angle. This makes it possible for the film member 546 to come in the cylinder section 54 at a shorter stroke of the shutter plate 527. Furthermore, this can further prevent toner existing between the toner discharge port 521 and the toner supply port 25 from being excessively pushed when the protruding tip end 546A1 protrudes out of the toner discharge port 521.

Further, the rotary member 54 includes the first conveying member 55 and the second conveying member 56. The cylindrical holding piece 544 is fitted on the stem 545 of the container gear 54G. The cylindrical holding piece 544 supports the film member 546. In order to ensure these functions of the cylindrical holding piece 544, the downstream end (second end 543) of the first conveying member 55 is located further upstream than the toner discharge port 521 in the second conveyance direction.

A part of toner conveyed from the container housing 51 to the toner discharge port 521 that has not been discharged through the toner discharge port 521 is conveyed back to the container housing 51 by the first conveying member 55. The conveyance upstream end 546B1 of the conveying portion 546B of the film member 546 is located further upstream than the second end 543 of the first conveying member 55 in the second conveyance direction. In other words, as shown in FIG. 12, the first conveying member 55 and the film member 546 overlap by the overlap width P. Because of the overlapping area having the overlap width P, toner that has been conveyed to the vicinity of the second end 543 by the second conveying member 56 and the dispersing members 57 (FIG. 9) is led to the toner discharge port 521 by circular movement of the conveying portion 546B.

This makes it possible to reliably convey toner from the inside of the container housing 51 to the toner discharge port 521 via the cylinder section 52 and the conveying portion 546B of film member 546. In other words, it is possible to prevent a large portion of toner conveyed by the second conveying member 56 from being conveyed back to the container housing 51 before reaching the toner discharge port 521. Further, as described above, the radially outer end edge of the conveying portion 546B is not in contact with the inner surface of the cylinder section 52, which makes it possible to prevent the conveying portion 546B from hindering the film member 546 from releasing an elastic force when protruding out of the toner discharge port 521.

Figure 13:
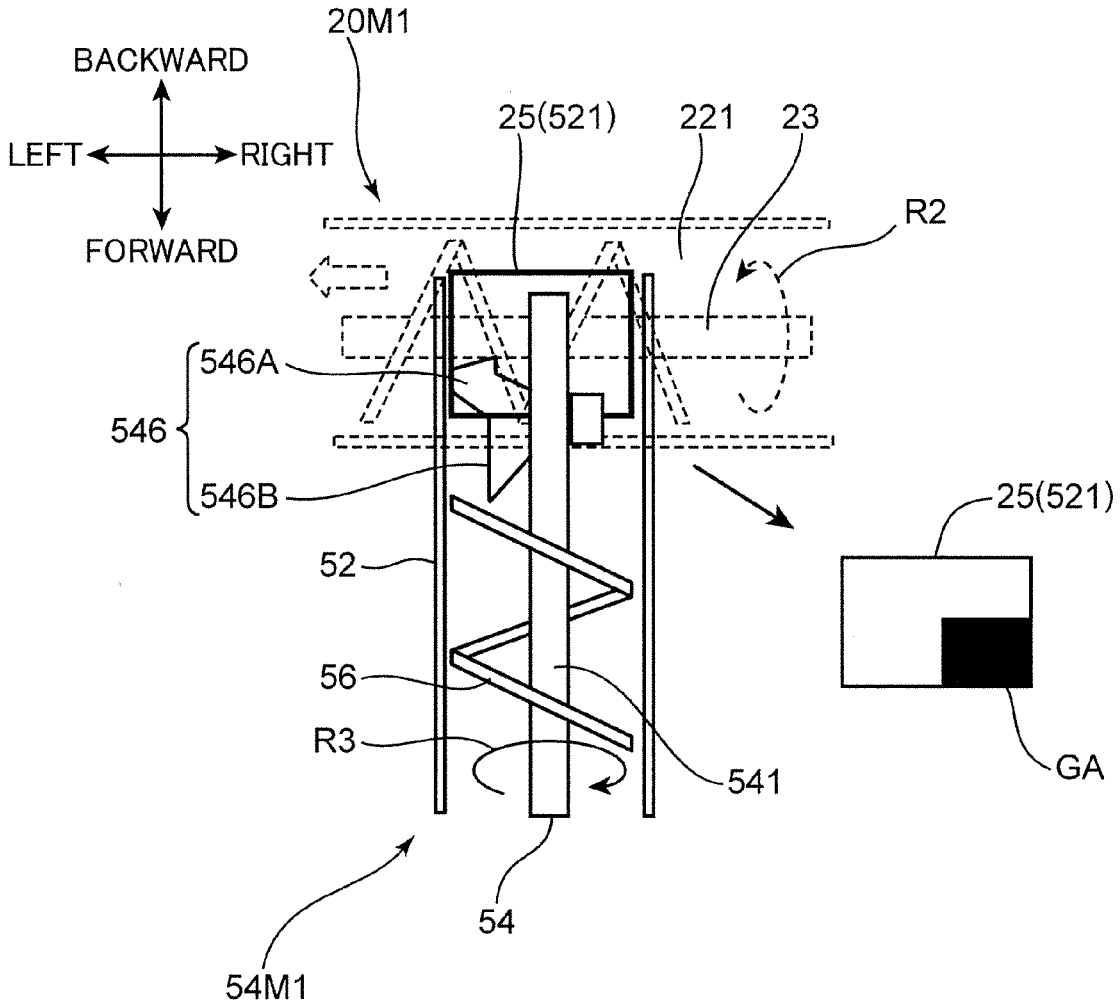
FIG. 13 is a schematic plan view illustrating discharge of developer from a developer container according to a second embodiment of the present disclosure.

Now, with reference to FIG. 13, there will be described a film member 546 mounted to a rotary member 54M1 according to a second embodiment of the present disclosure. Here, description will be made regarding only features different from those of the first embodiment, and repeated description of the other common features will be omitted. FIG. 13 is a schematic view illustrating discharge of toner through the toner discharge port 521 by the rotary member 54M1. In FIG. 13, the toner discharge port 521 and the toner supply port 25 face each other, and a part of the developing device 20M1 is shown by dashed lines. The rotary member 54M1 is different from the rotary member 54 of the first embodiment in that a second conveying member 56 further extends over a second part 54B of a rotary shaft 541. FIG. 13 does not show a first conveying member 55 of the rotary member 54M1. In this case that the second conveying member 56 further extends over the second part 54B of the rotary member 54M1, toner is positively conveyed to the toner discharge port 521 in a cylinder section 52.

On the other hand, a first stirring screw 23 of the developing device 20M1 is rotated in the direction of an arrow R2 to convey toner in a direction (third direction) perpendicularly intersecting a direction (second direction) in which the second conveying member 56 conveys toner. The toner discharge port 521 is located above the toner supply port 25, and similarly to the first embodiment, a protruding tip end 546A1 (FIG. 12) of the film member 546 comes to protrude between the toner discharge port 521 and the toner supply port 25.

At this time, in the second embodiment, a stretching portion 546A of the film member 546, in a direction of viewing the toner discharge port 521 and the toner supply port 25 facing each other from top, protrudes out of the toner discharge port 521 to an area GA with rotation of the rotary shaft 541. Here, the area GA refers to a specific area of the toner supply port 25 where a screw blade of the first stirring screw 23 moves upward from a lower position. In the area GA, toner is pushed upward from a lower position with the rotation of the first stirring screw 23 in the arrow R2 direction. Therefore, especially aggregation of toner is likely to occur between the toner discharge port 521 and the toner supply port 25.

In addition, in the area GR, a screw blade of the second conveying member 56 moves downward from an upper position with rotation of the second conveying member 56 on the rotary shaft 541 (in a direction R3). Therefore, in the area GA, toner in the developing device 20M1 is pushed upward from the toner supply port 25 and, at the same time, toner in the cylinder section 52 is pushed downward from the toner discharge port 521. Therefore, especially aggregation of toner is likely to occur between the toner discharge port 521 and the toner supply port 25. In view of the above, each member is so configured as to allow the protruding tip end 546A1 of the film member 546 to protrude toward the area GA to thereby prevent the aggregation of toner. Even in the case that the second conveying member 56 does not extend over the second part 54B, the aggregation of toner can be similarly prevented by the configuration in which the protruding tip end 546A1 of the second conveying member 56 protrudes toward the area GA.

Figure 14:
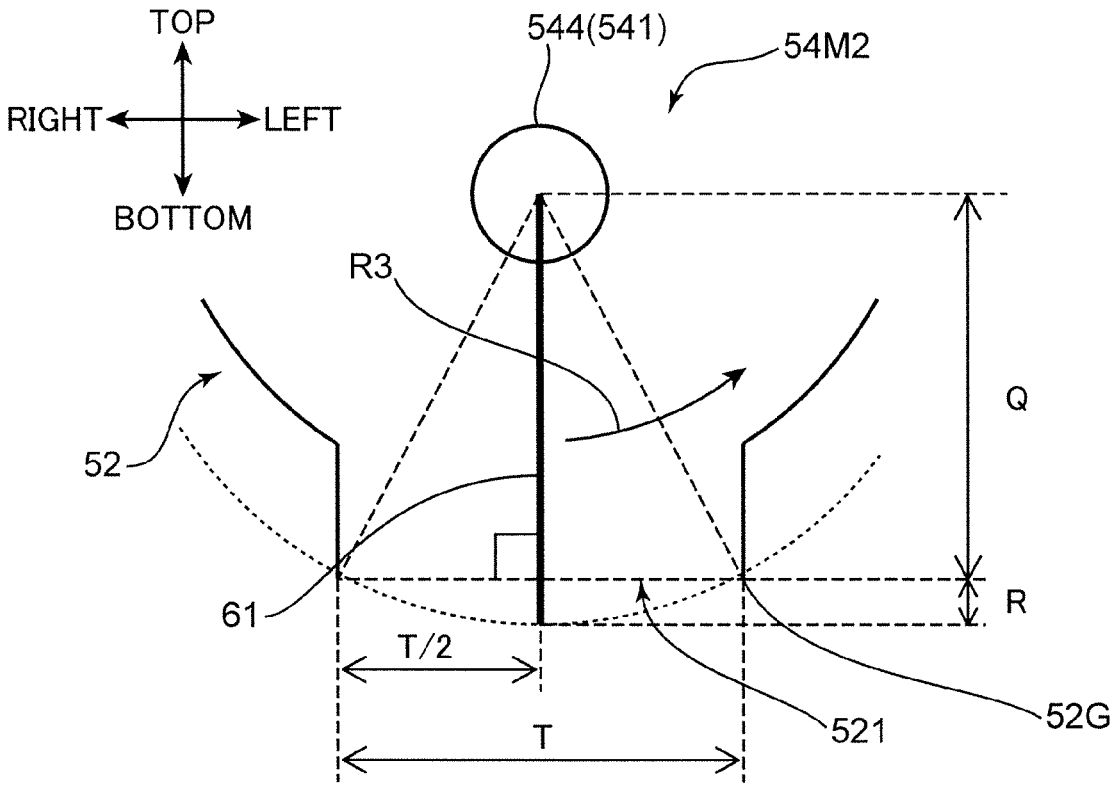
FIG. 14 is a schematic sectional view of the vicinity of a developer discharge port of a developer container according to a third embodiment of the present disclosure.

Now, with reference to FIG. 14, there will be described a film member 61 mounted to a rotary member 54M2 according to a third embodiment of the present disclosure. Here, description will be made regarding only features different from those of the first embodiment, and repeated description of the other common features will be omitted. FIG. 14 is a schematic sectional view of the vicinity of a toner discharge port 521 and the rotary member 54M2 placed in a cylinder section 52, the sectional view perpendicularly intersecting an axial direction of a cylindrical holding piece 544 (rotary shaft 541).

The third embodiment differs from the first embodiment in that the film member 61 extends along a straight line passing a rotational axis of the cylindrical holding piece 544. The film member 61, axially (in the forward and backward direction), has the same shape as the film member 546 of the first embodiment. As the film member 61 circularly moves in an arrow R3 direction from the state shown in FIG. 14, a radial tip end of the film member 61 protrudes out of the toner discharge port 521 radially outward of the cylinder section 52 after rubbing an inner surface of the cylinder section 52. FIG. 14, similarly to FIG. 12, shows reference numerals Q, R and T. Specifically, Q denotes a shortest distance from the rotational axis of the rotary shaft 541 to the bottom of the toner discharge port 521. R denotes a length of the tip end of the film member 61 protruding out of the toner discharge port 521. T denotes a lateral opening width (measured in a direction perpendicularly intersecting the axial direction of the rotary shaft 541) of the toner discharge port 521. The toner discharge port 521 is formed by cutting a part of a circumference surface of the cylinder section 52 to form an opening extending downward.

In the third embodiment, the length of the film member 61 and the shape of the toner discharge port 521 satisfy the following relation: $(Q+R)^2 \leq Q^2+(T/2)^2$, the tip end of the film member 61 protruding out of the toner discharge port 521 according to rotation of the rotary shaft 541 reaches a lower end 52G of the toner discharge port 521 when the rotary shaft 541 is further rotated. At this time, if the above relation is satisfied, the tip end of the film member 61 comes in contact with the lower end 52G, or comes in the inner side of the lower end 52G of the cylinder section 52. Thereafter, the film member 61 circularly moves while rubbing the inner surface of the cylinder section 52. This allows the film member 61 to exhibit a function of breaking aggregates of toner under the toner discharge port 521 and to reliably come in the cylinder section 52.

Although the toner container 50 and the image forming apparatus 1 including the same according to the embodiments of the present disclosure have been described, the present disclosure is not limited to the above-described embodiments and, for example, the following modified embodiments may be adopted.

Figure 15:
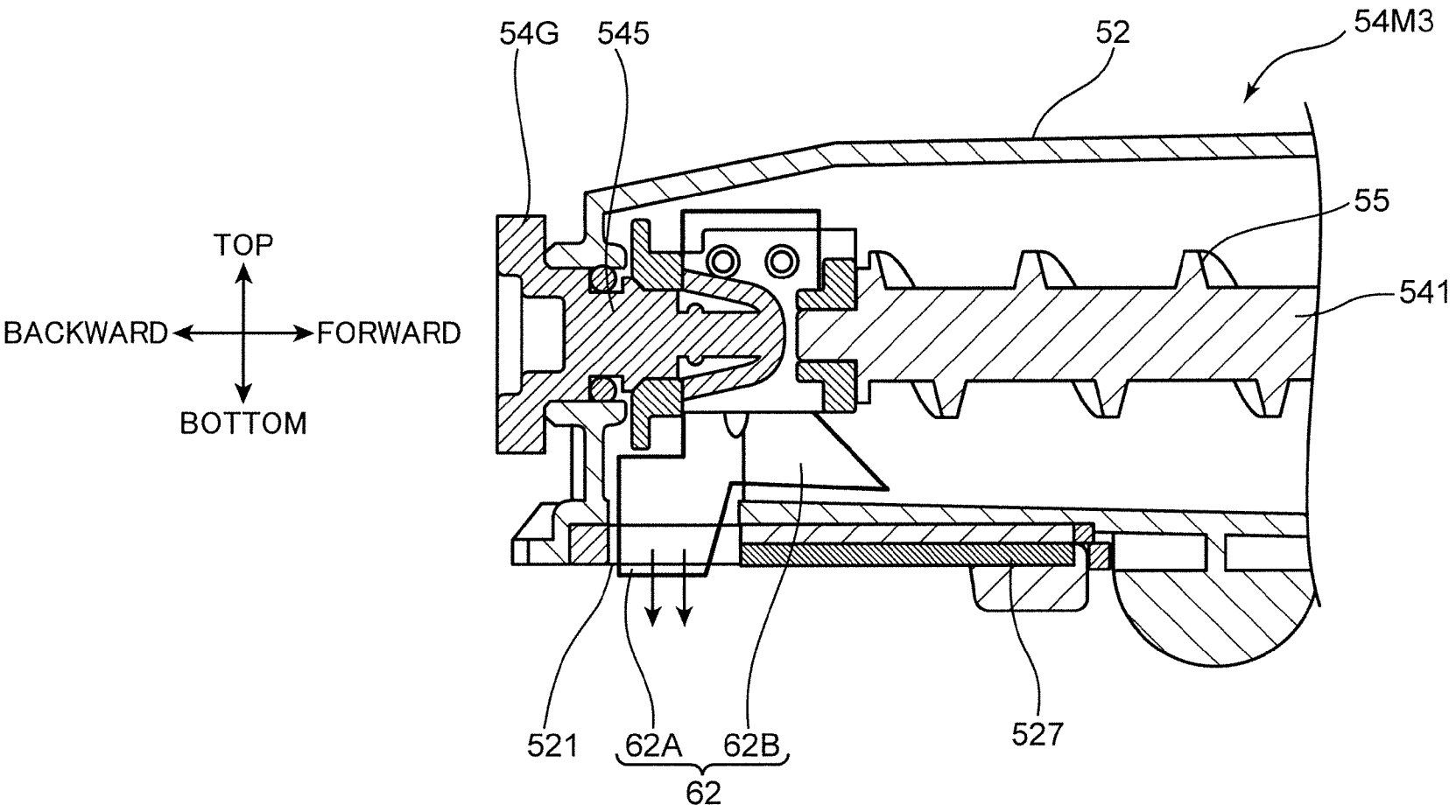
FIG. 15 is a sectional view of the vicinity of a developer discharge port of a developer container according to a modified embodiment of the present disclosure.

(1) In the above-described embodiments, the stretching portion 546A of the film member 546 has the tapering triangular shape. However, the shape of the stretching portion 546A of the film member 546 according to the present disclosure is not limited to this. FIG. 15 is a sectional view of the vicinity of a film member 62 provided in a rotary member 54M3 according to a modified embodiment. The film member 62 includes a stretching portion 62A and a conveying portion 62B. The conveying portion 62B has the same shape as the conveying portion 546B of the first embodiment. On the other hand, the stretching portion 62A has a rectangular shape.

Even if the stretching portion 62A of the film member 62 has a rectangular shape, its radial end protrudes radially out of a toner discharge port 521 after rubbing an inner surface of a cylinder section 52 as a rotary shaft 541 rotates. This makes it possible to break toner aggregated under the toner discharge port 521. It is preferable also in the present modified embodiment that the other part of the film member 62 be not in contact with the inner surface of the cylinder section 52 in the state that the radial end of the film member 62 protrudes out of the toner discharge port 521. Therefore, a radial outer end edge of the conveying portion 62B is spaced from the inner surface of the cylinder section 52 by a predetermined distance. Further, also in the present modified embodiment, the stretching portion 62A of the film member 62 has an oblique end edge facing a shutter plate 527. Therefore, when the shutter plate 527 comes in contact with the oblique part of the stretching portion 62A, the stretching portion 62A curves in a circumferential direction of the rotary shaft 541 and smoothly comes in the cylinder section 52.

(2) In the above-described embodiments, magnetic toner is used as developer. Alternatively, one-component developer using non-magnetic toner or a two-component developer including magnetic career may be used. Further, the reception unit for receiving toner supplied from the toner container 50 is not limited to those which are mounted in the developing device 20, and an independent intermediate hopper for temporarily storing replenishment toner may alternatively be used.

As described above, the present disclosure provides a developer container capable of consistently supplying developer while preventing aggregation of discharged developer, and an image forming apparatus including the same.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. A developer container for supplying developer to a reception unit including a developer receiving port, the developer container comprising:

a container housing including a bottom wall for storing developer;

a cylinder section joining the bottom wall and projecting from the container housing, the cylinder section including a lower surface formed with a developer discharge port facing the developer receiving port;

a rotary member extending in the container housing and the cylinder section, and operable to be rotationally driven to convey the developer in the container housing to the developer discharge port; and a shutter disposed in the cylinder section and being slidable in an axial direction of rotation of the rotary member for closing and opening the developer discharge port, wherein the rotary member includes a rotary shaft rotatably supported on the container housing and the cylinder section, the rotary shaft extending in an extending direction of the bottom wall and including a first part located in the container housing and a second part located in the cylinder section, and a resilient member projecting from the second part of the rotary shaft in a radial direction of rotation of the rotary member and facing the developer discharge port, the resilient member including a stretching portion that has a triangular shape tapering radially outward in a section view taken in the axial direction of rotation of the rotary member, and the stretching portion has a tip end operable to protrude radially outward out of the developer discharge port after rubbing an inner surface of the cylinder section as the rotary shaft of the rotary member makes rotation the shutter is disposed at a position where the shutter comes into contact with the oblique end of the stretching portion when the shutter slides in the axial direction of rotation of the rotary member in a state where the tip end of the stretching portion protrudes radially outward of the developer discharge port.

2. A developer container according to claim 1, wherein the resilient member has such a shape as to come in non-contact with the inner surface of the cylinder section in the state that the tip end of the resilient member protrudes out of the developer discharge port.

3. A developer container according to claim 1, wherein:

the rotary member includes a first conveying member extending over a circumferential surface of the second part of the rotary shaft, and having a spiral shape, and integrally rotatable with the rotary shaft for conveying the developer in a first conveyance direction from the cylinder section to the container housing, and a second conveying member extending over a circumferential surface of the first part of the rotary shaft, disposed at a position radially further outward than the first conveying member, and having a spiral shape, and integrally rotatable with the rotary shaft for conveying the developer in a second conveyance direction from the container housing to the cylinder section, the first conveying member has, in the second conveyance direction on the axis of the rotary shaft, a downstream end located further upstream than the developer discharge port, the resilient member includes a conveying portion rotatable with the rotary shaft in the cylinder section, the conveying portion joining the stretching portion at an upstream side in the second conveyance direction, and the conveying portion has an upstream end located further upstream than the downstream end of the first conveying member in the second conveyance direction.

4. A developer container according to claim 3, wherein the conveying portion includes a radially outer end edge operable to circularly move at a position spaced inward from the inner surface of the cylinder section with the rotation of the rotary member with the rotary shaft.

5. An image forming apparatus, comprising:

an image carrier including a surface for allowing an electrostatic latent image to be formed thereon;

the reception unit having the developer receiving port, and serving as a developing device for supplying the developer to the image carrier; and the developer container according to claim 1 for supplying the developer to the developing device.

6. An image forming apparatus according to claim 5, wherein:

the developing device includes:

a housing for storing the developer;

a developer conveyance passage disposed in the housing for conveying the developer;

the developer receiving port formed in a top of the developer conveyance passage; and a conveying screw lying in the developer conveyance passage and passing under the developer receiving port, the conveying screw including a rotary shaft member, and being operable to be rotationally driven for conveying the developer in a third conveyance direction and the conveying screw includes a conveying ability reduction portion for partially reducing the conveying ability of the conveying screw of conveying developer in the third conveyance direction at a certain location in a downstream of the developer receiving portion in the third conveyance direction.

7. An image forming apparatus according to claim 6, wherein the conveying screw includes a screw blade formed around the rotary shaft member, and the conveying ability reduction portion is defined by a cutout of the screw blade.

8. An image forming apparatus according to claim 7, wherein the third conveyance direction perpendicularly intersects a second conveyance direction, and the tip end of the resilient member, in a direction of viewing the developer discharge port and the developer receiving port facing each other from top, protrudes out of the developer discharge port to a specific area of the developer receiving port where the screw blade moves upward from a lower position.

9. An image forming apparatus according to claim 8, wherein the second conveying member further extends over the circumferential surface of the first part of the rotary shaft, and the tip end of the resilient member, in the direction of viewing the developer discharge port and the developer receiving port from top, protrudes out of the developer discharge port to another specific area of the developer receiving port where the second conveying member moves downward from an upper position.

10. A developer container according to claim 1, wherein the resilient member includes the stretching portion and a conveying portion that joins the stretching portion at the upstream side in a second conveyance direction and circularly moves with rotation of the rotary shaft in the cylinder section, the stretching portion and a conveying portion are configured so as not to contact the inner surface of the cylinder section when the tip end protrudes out of the developer discharge port.

11. A developer container for supplying developer to a reception unit that includes a developer receiving port, the developer container comprising:

a container housing including a bottom wall for storing developer;

a cylinder section joining the bottom wall and projecting from the container housing, the cylinder section including a lower surface formed with a developer discharge port facing the developer receiving port; and a rotary member extending in the container housing and the cylinder section, and operable to be rotationally driven to convey the developer in the container housing to the developer discharge port, wherein the rotary member includes a rotary shaft rotatably supported on the container housing and the cylinder section, the rotary shaft extending in an extending direction of the bottom wall and including a first part located in the container housing and a second part located in the cylinder section, and a resilient member projecting from the second part of the rotary shaft in a radial direction of rotation of the rotary member and facing the developer discharge port, the resilient member including a tip end operable to protrude radially outward out of the developer discharge port after rubbing an inner surface of the cylinder section as the rotary shaft of the rotary member makes rotation the resilient member extends along a straight line on a rotational axis of the rotary shaft in a sectional view perpendicularly intersecting an axial direction of rotation of the rotary member, and the following formula is satisfied: $(Q+R)^2 \leq Q^2+(T/2)^2$, where Q is a shortest distance between the rotational axis and the developer discharge port, R is a protruding length of the tip end of the resilient member maximally protruding out of the developer discharge port, and T is an opening length of the developer discharge port extending in a direction perpendicularly intersecting the axial direction.

12. A developer container according to claim 11, wherein the resilient member includes a stretching portion bearing the tip end and tapering radially outward.

13. A developer container according to claim 12, further comprising:

a shutter disposed in the cylinder section for closing and opening the developer discharge port with sliding in an axial direction of rotation of the rotary member, wherein when the shutter is slid to close the developer discharge port and comes in contact with the stretching portion in the state that the tip end protrudes out of the developer discharge port, the stretching portion is operable to curve in a circumferential direction of rotation of the rotary member and come in the cylinder section.

14. A developer container according to claim 12, wherein the stretching portion, in the state that the tip end protrudes out of the developer discharge port, has a triangular shape tapering radially outward in a sectional view taken in an axial direction of rotation of the rotary member.

15. A developer container according to claim 14, wherein the triangular shape has an acute angle at the tip end.

* * * * *